US007349642B2

(12) United States Patent
Tatematsu et al.

(10) Patent No.: US 7,349,642 B2
(45) Date of Patent: Mar. 25, 2008

(54) IMAGE HEATING APPARATUS INCLUDING PID CONTROL

(75) Inventors: Hideki Tatematsu, Ashiya (JP); Masahiro Samei, Toyonaka (JP); Tomoyuki Noguchi, Kasuga (JP); Shigemitsu Tani, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 261 days.

(21) Appl. No.: 11/073,717

(22) Filed: Mar. 8, 2005

(65) Prior Publication Data

US 2005/0201768 A1 Sep. 15, 2005

(30) Foreign Application Priority Data

Mar. 10, 2004 (JP) ..... 2004-068033

(51) Int. Cl.
*G03G 15/20* (2006.01)

(52) U.S. Cl. ..... 399/69

(58) Field of Classification Search ..... 399/69
See application file for complete search history.

(56) References Cited

U.S. PATENT DOCUMENTS

2004/0037580 A1* 2/2004 Ohta ..... 399/69
2006/0083530 A1* 4/2006 Bartley et al. ..... 399/70
2007/0036570 A1* 2/2007 Tatematsu et al. ..... 399/69

FOREIGN PATENT DOCUMENTS

JP 2001-222191 8/2001

OTHER PUBLICATIONS

English Language Abstract of JP 2001-222191.
U.S. Appl. No. 10/765,974 to Nonaka et al., filed Jan. 29, 2004.

* cited by examiner

*Primary Examiner*—David M. Gray
*Assistant Examiner*—Ruth N LaBombard
(74) *Attorney, Agent, or Firm*—Greenblum & Bernstein, P.L.C.

(57) ABSTRACT

PID control performs integral control using an integral value of a deviation between a set temperature and current temperature. In particular, when a proportionality factor Kp is large, a fixing belt reaches a target temperature quickly but overshoot increases. On the other hand, when the proportionality factor Kp is small, the output is reduced gradually, and therefore the fixing belt reaches a target temperature slowly but the overshoot is small. Thus, a heat value control section changes the control value of the PID control according to the temperature (belt temperature) of a fixing belt at the start of heating as detected by a temperature detector. More specifically, a proportionality factor Kp of a calculation expression of the PID calculation is changed according to the belt temperature of the fixing belt. This makes it possible to reduce an overshoot when the temperature of the fixing belt increases.

5 Claims, 17 Drawing Sheets

| | |
|---|---|
| VOLTAGE VALUE | :Vval [volt] |
| CURRENT VALUE | :Ival [amp] |
| AD VALUE OF VOLTAGE | :ADv |
| AD VALUE OF CURRENT | :ADi |

SPECIFIES :

100V SYSTEM/50Hz

Vval=0.7112×ADv−33.0290 [volt] ··· EXPRESSION 5 − 1
Ival=0.0533×ADi−1.5059 [amp] ··· EXPRESSION 5 − 2

100V SYSTEM/60Hz

Vval=0.7148×ADv−33.1930 [volt] ··· EXPRESSION 5 − 3
Ival=0.0535×ADi−1.6145 [amp] ··· EXPRESSION 5 − 4

200V SYSTEM/50Hz

Vval=1.4048×ADv−63.7730 [volt] ··· EXPRESSION 5 − 5
Ival=0.0269×ADi−0.8516 [amp] ··· EXPRESSION 5 − 6

200V SYSTEM/60Hz

Vval=1.4048×ADv−63.7730 [volt] ··· EXPRESSION 5 − 7
Ival=0.0268×ADi−0.9182 [amp] ··· EXPRESSION 5 − 8

FIG. 5

< 100V SYSTEM >

| SUPPLY VOLTAGE | MINIMUM POWER (W) |
|---|---|
| V<80v | 450 |
| 80v≦V<85v | 462.5 |
| 85v≦V<90v | 475 |
| 90v≦V<95v | 487.5 |
| 95v≦V<100v | 500 |
| 100v≦V<105v | 525 |
| 105v≦V<110v | 550 |
| 110v≦V<115v | 575 |
| 115v≦V<120v | 600 |
| 120v≦V<122.5v | 630 |
| 122.5v≦V<125v | 660 |
| 125v≦V<127.5v | 690 |
| 127.5v≦V<130v | 720 |
| 130v≦V<132.5v | 750 |
| 132.5v≦V<135v | 775 |
| 135v≦V | 800 |

FIG.7A

< 200V SYSTEM >

| SUPPLY VOLTAGE | MINIMUM POWER (W) |
|---|---|
| V<185v | 300 |
| 185v≦V<195v | 324 |
| 195v≦V<205v | 348 |
| 205v≦V<215v | 405 |
| 215v≦V<225v | 461 |
| 225v≦V<235v | 518 |
| 235v≦V<245v | 574 |
| 245v≦V<255v | 630 |
| 255v≦V<265v | 687 |
| 265v≦V<275v | 743 |
| 275v≦V | 800 |

FIG.7B

< 100V SYSTEM >

| SUPPLY VOLTAGE | RegVal(min) CALCULATION EXPRESSION | |
|---|---|---|
| V<80v | RegVal=0.0095×V×V+256.35−2.8075×V | EXPRESSION 9 − 1 |
| 80v≦V<85v | RegVal=0.0103×V×V+269.08−3.0034×V | EXPRESSION 9 − 2 |
| 85v≦V<90v | RegVal=0.0098×V×V+267.45−2.9311×V | EXPRESSION 9 − 3 |
| 90v≦V<95v | RegVal=0.0105×V×V+277.55−3.0939×V | EXPRESSION 9 − 4 |
| 95v≦V<100v | RegVal=0.0113×V×V+288.95−3.2668×V | EXPRESSION 9 − 5 |
| 100v≦V<105v | RegVal=0.0118×V×V+301.85−3.4279×V | EXPRESSION 9 − 6 |
| 105v≦V<110v | RegVal=0.0117×V×V+306.45−3.4405×V | EXPRESSION 9 − 7 |
| 110v≦V<115v | RegVal=0.0129×V×V+324.53−3.7273×V | EXPRESSION 9 − 8 |
| 115v≦V<120v | RegVal=0.0133×V×V+334.73−3.8423×V | EXPRESSION 9 − 9 |
| 120v≦V<122.5v | RegVal=0.0138×V×V+344.85−3.9646×V | EXPRESSION 9 − 10 |
| 122.5v≦V<125v | RegVal=0.0142×V×V+356.88−4.1027×V | EXPRESSION 9 − 11 |
| 125v≦V<127.5v | RegVal=0.0145×V×V+365.25−4.1875×V | EXPRESSION 9 − 12 |
| 127.5v≦V<130v | RegVal=0.0146×V×V+373.58−4.2534×V | EXPRESSION 9 − 13 |
| 130v≦V<132.5v | RegVal=0.0149×V×V+382.38−4.3527×V | EXPRESSION 9 − 14 |
| 132.5v≦V<135v | RegVal=0.0149×V×V+386.78−4.3755×V | EXPRESSION 9 − 15 |
| 135v≦V | RegVal=0.0150×V×V+391.60−4.4129×V | EXPRESSION 9 − 16 |

FIG.9A

< 200V SYSTEM >

| SUPPLY VOLTAGE | RegVal(min) CALCULATION EXPRESSION | |
|---|---|---|
| V<185v | RegVal=0.0017×V×V+220.36−1.1179×V | EXPRESSION 9 − 17 |
| 185v≦V<195v | RegVal=0.0018×V×V+228.27−1.1582×V | EXPRESSION 9 − 18 |
| 195v≦V<205v | RegVal=0.0020×V×V+245.84−1.2776×V | EXPRESSION 9 − 19 |
| 205v≦V<215v | RegVal=0.0023×V×V+269.77−1.4143×V | EXPRESSION 9 − 20 |
| 215v≦V<225v | RegVal=0.0024×V×V+290.69−1.5181×V | EXPRESSION 9 − 21 |
| 225v≦V<235v | RegVal=0.0025×V×V+314.62−1.6548×V | EXPRESSION 9 − 22 |
| 235v≦V<245v | RegVal=0.0030×V×V+346.10−1.8577×V | EXPRESSION 9 − 23 |
| 245v≦V<255v | RegVal=0.0030×V×V+358.33−1.8926×V | EXPRESSION 9 − 24 |
| 255v≦V<265v | RegVal=0.0033×V×V+387.66−2.0702×V | EXPRESSION 9 − 25 |
| 265v≦V<275v | RegVal=0.0037×V×V+415.73−2.2425×V | EXPRESSION 9 − 26 |
| 275v≦V | RegVal=0.0038×V×V+437.73−2.3590×V | EXPRESSION 9 − 27 |

FIG.9B

IMAGE HEATING APPARATUS INCLUDING PID CONTROL

BACKGROUND OF THE INVENTION

1. Field of the Invention

The present invention relates to an image heating apparatus which heats an unfixed image on a recording medium, and more particularly, to an image heating apparatus effectively applicable to a fixing apparatus for an image formation apparatus such as a copier, facsimile and printer based on an electrophotography scheme or electrostatic recording scheme.

2. Description of the Related Art

In recent years, attention is being given to a fixing apparatus, from the standpoints of energy saving and ease of use, capable of heating an image heating body for heating an unfixed image on a recording medium up to a target temperature in a short time and making a quick start.

As an image heat generation section for this type of fixing apparatus, one using an image heating apparatus based on an induction heating (IH) scheme is known. This image heating apparatus generates an eddy current by causing a magnetic field generated by an induction heating apparatus to act on an image heating body and heats an unfixed image on a recording medium such as transfer paper and OHP (Over Head Projector) sheet with Joule heat of the image heating body caused by this eddy current.

Compared to an image heating apparatus using a halogen lamp as a heat source of a heat generation section that heats the image heating body, this IH-scheme image heating apparatus has an advantage of having high heat generating efficiency and being capable of increasing a fixing speed. Furthermore, the image heating apparatus using a thin sleeve or belt, etc., as the image heating body has a small heat capacity of the image heating body, can heat this image heating body in a short time and improve rising response considerably.

The fixing apparatus using this type of image heating apparatus keeps maximum power output so as to make a warm-up time as short as possible and controls the temperature of the image heating body so as to tolerate a certain degree of overshoot with respect to a target temperature and shorten a time required to reach the target temperature. A tolerance of the overshoot with respect to this target temperature is approximately 5° C. This is because if the overshoot exceeds the target temperature by 10° C. or more, a luster variation occurs on the fixed image.

In such a fixing apparatus, there is only a certain degree of overshoot when the temperature of the image heating body is low, but when the temperature of the image heating body increases from a state in which the temperature is relatively high, there is a problem that an excessive power output is required, causing an excessively large overshoot.

For this reason, this type of fixing apparatus causes a large overshoot of the image heating body, producing an offset or producing a luster variation during printing of a first sheet.

Therefore, a method for this type of conventional fixing apparatus to change a power supply output of the image heating apparatus according to the temperature of the image heating body is proposed in a Patent Document (Unexamined Japanese Patent Publication No. 2001-222191) etc.

That is, the fixing apparatus disclosed in the Patent Document is provided with a temperature detection section made up of a thermistor in the vicinity of the image heating body to detect the temperature of the image heating body and select optimum power from among 700 W to 1300 W according to the temperature of the image carrier. More specifically, a control circuit of the main body given the output of the thermistor selects any one level of the power based on the detected temperature of the image heating body and outputs a power control signal to an IH control circuit.

On the other hand, the IH-scheme image heating apparatus normally controls power supplied to a heat source using values calculated based on a predetermined control rule in accordance with the detected temperature of the temperature detection section which contacts the image heating body or which is placed in the vicinity thereof and thereby keeps the image heating body to a predetermined fixing temperature (target temperature).

As the above described control rule, PID (Proportional, Integral, Derivative) control including PI control and PD control is used. This PID control performs control by not only causing the amount of operation of the power control section to be proportional to a deviation between the detected temperature of the temperature detection section and the target temperature of the image heating body based on the trend of increase/decrease of the deviation but also taking into account elements proportional to the integral of the deviation or elements proportional to the derivation of the deviation.

Furthermore, the temperature information from the temperature detection section is sampled in a certain period (sampling period) and incorporated into the control rule of PID control.

When the temperature of the entire apparatus of such an image heating apparatus is low, it is preferable to heat the image heating body through PID control with such a setting that causes the image heating body to overshoot the target temperature to a certain degree because the warm-up time is shortened in this way.

However, if the ambient temperature of the image heating apparatus is already high, when the image heating body is heated next, heating the image heating body through PID control with the same setting as that when the temperature of the entire apparatus is low increases the temperature rising rate of the image heating body and increases the overshoot.

Furthermore, the magnetic characteristic of this type of image heating apparatus changes as the temperature of the image heating body increases, and therefore when the image heating body is heated through the PID control with the same setting as that at the time of low temperature, there is a problem that it is hard to enter the output when the temperature is high.

SUMMARY OF THE INVENTION

It is an object of the present invention to provide an image heating apparatus capable of reducing an overshoot when the temperature of the image heating body increases.

An aspect of the invention is an image heating apparatus comprising an image heating body that heats an unfixed image on a recording medium, a heat generation section that induction-heats the image heating body, a temperature detection section that detects the temperature of the image heating body and a power control section that controls power supplied to the heat generation section through PID control based on the detected temperature of the temperature detection section so that the temperature of the image heating body is kept to an image fixing temperature which is appropriate for heating and fixing of the unfixed image to the recording medium, wherein the control value of the PID control is changed according to the temperature of the image heating body at the start of heating detected by the temperature detection section.

Another aspect of the invention is an image heating apparatus comprising a belt-shaped image heating body that heats an unfixed image on a recording medium, a heat generation section that induction-heats the image heating body, a pressurizing section that carries the recording medium under pressure through a nip section which is formed by being pressed to the image heating body and rotated, a temperature detection section that detects the temperature of the pressurizing section and a power control section that controls power supplied to the heat generation section through PID control based on the detected temperature of the temperature detection section so that the temperature of the image heating body is kept to an image fixing temperature appropriate for heating and fixing of the unfixed image to the recording medium, wherein the control value of the PID control is changed according to the temperature of the pressurizing section detected by the temperature detection section.

A still further aspect of the invention is an image heating apparatus comprising a belt-shaped image heating body that heats an unfixed image on a recording medium, a heat generation section that induction-heats the image heating body, a first temperature detection section that detects the temperature of the image heating body, a pressurizing section that pressurizes and carries the recording medium through a nip section which is formed by being pressed to the image heating body and rotated, a second temperature detection section that detects the temperature of the pressurizing section and a power control section that controls power supplied to the heat generation section through PID control based on the detected temperature of the first temperature detection section and the second temperature detection section so that the temperature of the image heating body is kept to an image fixing temperature appropriate for heating and fixing of the unfixed image to the recording medium, wherein when the temperature of the pressurizing section is lower than a predetermined default value, the control value of the PID control according to the temperature of the pressurizing section detected by the second temperature detection section is changed and when the temperature of the pressurizing section is equal to or higher than the default value, the control value of the PID control is changed according to the temperature of the image heating body detected by the first temperature detection section.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which;

FIG. 5 illustrates a method of acquiring a current value and voltage value input to an inverter circuit of the fixing apparatus corresponding to Embodiment 1;

FIG. 7A illustrates a method of acquiring a minimum power value when the image formation apparatus corresponding to Embodiment 1 is connected to a 100 V-based power supply;

FIG. 7B illustrates a method of acquiring a minimum power value when the image formation apparatus corresponding to Embodiment 1 is connected to a 200 V-based power supply;

FIG. 9A illustrates a method of acquiring lower limit data when the image formation apparatus corresponding to Embodiment 1 is connected to a 100 V-based power supply;

FIG. 9B illustrates a method of acquiring lower limit data when the image formation apparatus is connected to a 200 V-based power supply;

DETAILED DESCRIPTION OF THE PREFERRED EMBODIMENTS

Figure 1:
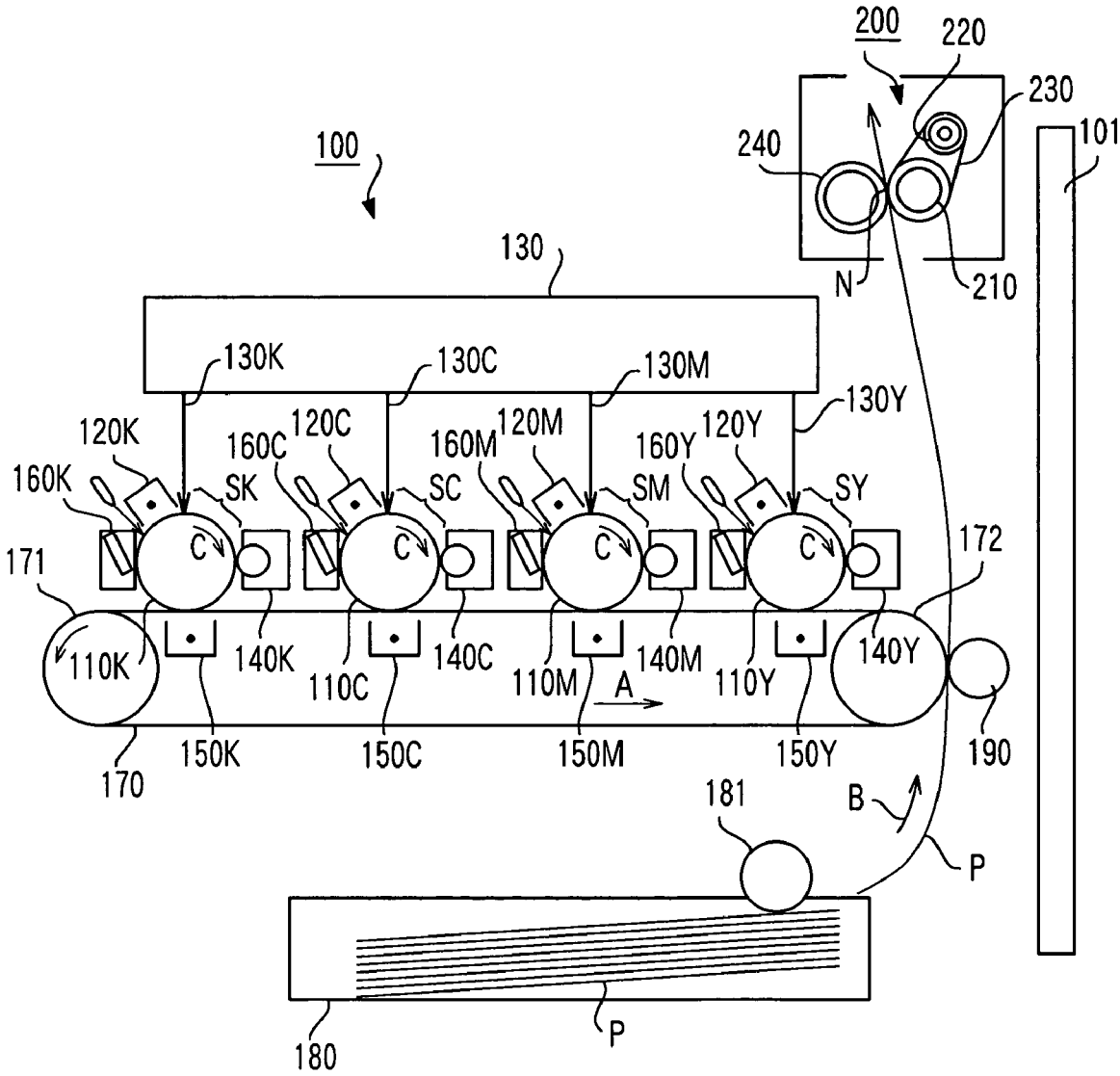
FIG. 1 is a schematic cross-sectional view of an image formation apparatus using an image heating apparatus according to Embodiment 1 of the present invention as a fixing apparatus.

With reference now to the attached drawings, embodiments of the present invention will be explained in detail below. Components and equivalent parts having the same configuration and function in each figure are assigned the same reference numerals and explanations thereof will not be repeated.

Embodiment 1

FIG. 1 is a schematic cross-sectional view of an image formation apparatus mounted with a fixing apparatus using an image heating apparatus according to Embodiment 1 of the present invention as an image heat generation section. This image formation apparatus 100 is a tandem-scheme image formation apparatus. In the image formation apparatus 100, toner images of four colors contributing to the coloring of a color image are individually formed on four image carriers, primary-transferred onto an intermediate transfer body overlapped on one another sequentially and then these primary transfer images are collectively transferred (secondary transfer) to a recording medium.

It goes without saying that the image heating apparatus according to this Embodiment 1 is not limited to only the tandem-scheme image formation apparatus, but can be mounted on all types of image formation apparatus.

In FIG. 1, suffixes Y, M, C, K of reference numerals assigned the respective components of the image formation apparatus 100 denote components involved in image formation such as; Y: yellow image, M: magenta image, C: cyan image; K: black image, and components of the same reference numeral have a common configuration.

The image formation apparatus 100 includes photosensitive drums 110Y, 110M, 110C, 110K as the four image carriers and an intermediate transfer belt (intermediate transfer body) 170. There are image formation stations SY, SM, SC, SK around the respective photosensitive drums 110Y, 110M, 110C, 110K. The image formation stations SY, SM, SC, SK are constructed of electrifiers 120Y, 120M, 120C, 120K, a photolithography machine 130, developing machines 140Y, 140M, 140C, 140K, transfer machines 150Y, 150M, 150C, 150K and cleaning apparatuses 160Y, 160M, 160C, 160K.

In FIG. 1, the respective photosensitive drums 110Y, 110M, 110C, 110K are rotated in a direction indicated by an arrow C. The surfaces of the respective photosensitive drums 110Y, 110M, 110C, 110K are uniformly charged to a predetermined potential by the electrifiers 120Y, 120M, 120C, 120K.

The surfaces of the respective photosensitive drums 110Y, 110M, 110C, 110K are irradiated with scanning lines 130Y, 130M, 130C, 130K of laser beams corresponding to image data of specific colors by the photolithography machine 130. In this way, electrostatic latent images for the corresponding specific colors are formed on the surfaces of the respective photosensitive drums 110Y, 110M, 110C, 110K.

The electrostatic latent images for the corresponding specific colors formed on the photosensitive drums 110Y, 110M, 110C, 110K are converted to visible images by the developing machines 140Y, 140M, 140C, 140K. In this way, unfixed images of four colors which contribute to the coloring of color images are formed on the respective photosensitive drums 110Y, 110M, 110C, 110K.

The toner images of four colors visualized on the photosensitive drums 110Y, 110M, 110C, 110K are primary-transferred to an endless intermediate transfer belt 170 as intermediate transfer bodies by the transfer machines 150Y, 150M, 150C, 150K. This causes the toner images of four colors formed on the photosensitive drums 110Y, 110M, 110C, 110K to be superimposed on one another sequentially, forming a full color image on the intermediate transfer belt 170.

After the photosensitive drums 110Y, 110M, 110C, 110K have transferred the toner images to the intermediate transfer belt 170, the cleaning apparatuses 160Y, 160M, 160C, 160K remove the residual toner remaining on their respective surfaces.

Here, the photolithography machine 130 is disposed with a predetermined angle with respect to the photosensitive drums 110Y, 110M, 110C, 110K. Furthermore, the intermediate transfer belt 170 is put round the driving roller 171 and driven roller 172 and rotated in a direction indicated by an arrow A in FIG. 1 as the driving roller 171 rotates.

On the other hand, a feed cassette 180 housing recording paper P such as printing paper as a recording medium is provided in the lower part of the image formation apparatus 100. The recording paper P is fed one sheet after another from the feed cassette 180 by a feed roller 181 in a direction indicated by an arrow B along a predetermined sheet route.

The recording paper P sent out into the sheet route passes through a transfer nip section formed of the outer surface of the intermediate transfer belt 170 put round the driven roller 172 and a secondary transfer roller 190 which contacts the outer surface of the intermediate transfer belt 170. A full color image (unfixed image) formed on the intermediate transfer belt 170 is collectively transferred to the recording paper P by the secondary transfer roller 190 when the recording paper P passes through the transfer nip section.

Figure 2:
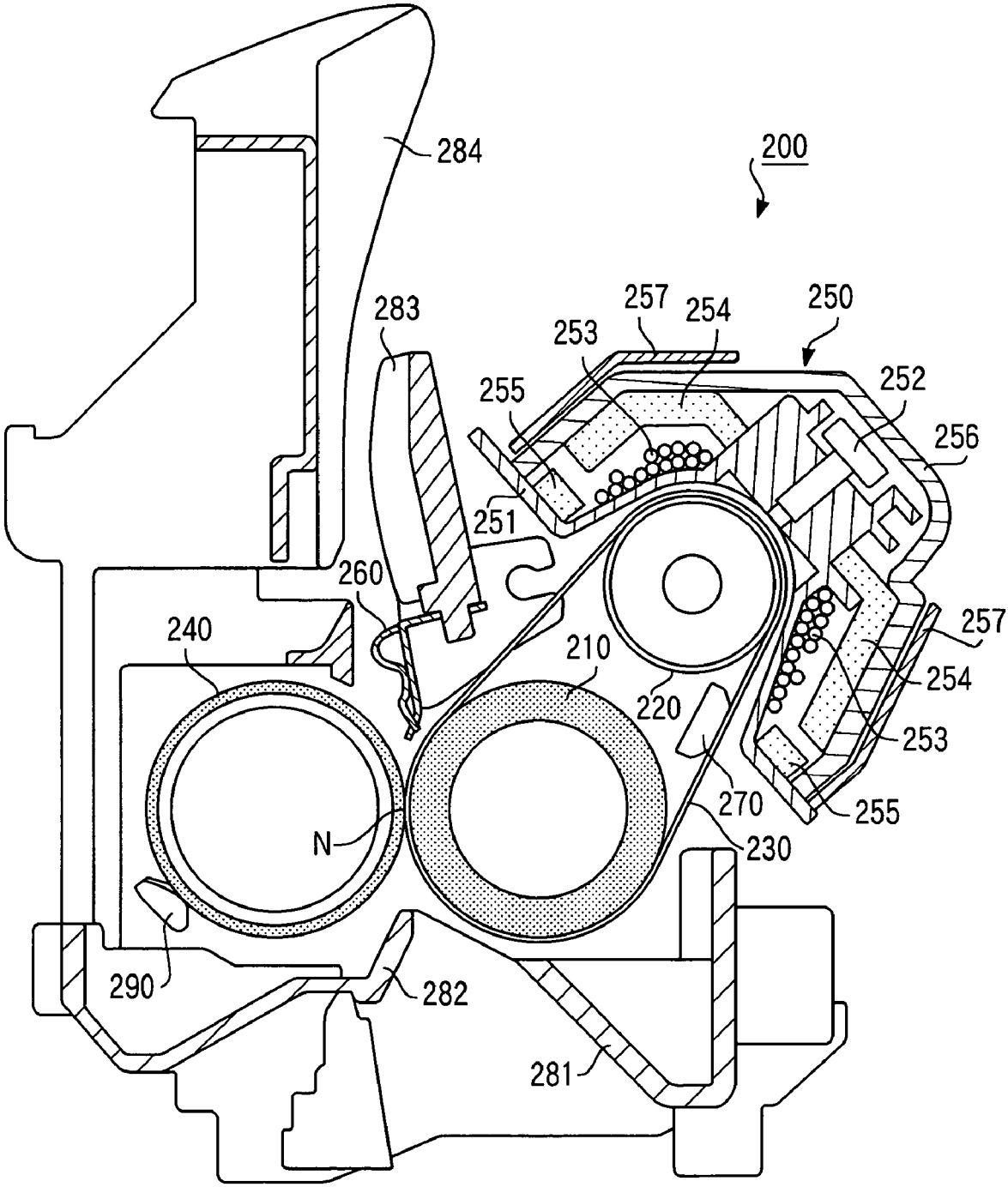
FIG. 2 is a schematic cross-sectional view of the configuration of a fixing apparatus corresponding to Embodiment 1.

Then, the recording paper P passes through a fixing nip section N formed of the outer surface of a fixing belt 230 which is put round a fixing roller 210 and a heat generating roller 220 of a fixing apparatus 200 which will be detailed in FIG. 2 and a pressurizing roller 240 which contacts the outer surface of the fixing belt 230. This causes an unfixed full color image which has been collectively transferred by the transfer nip section to be heated and fixed to the recording paper P.

The image formation apparatus 100 is provided with a door 101 which is freely opened/closed and which forms part of a housing thereof and by opening/closing this door 101, it is possible to replace the fixing apparatus 200, carry out maintenance and unjamming of the recording paper P stuck in the sheet transfer route.

Next, the fixing apparatus which is mounted in the image formation apparatus 100 will be explained. FIG. 2 is a schematic cross-sectional view showing the configuration of the fixing apparatus 200 using the image heating apparatus according to Embodiment 1 of the present invention.

The fixing apparatus 200 uses an image heating apparatus based on an induction heating (IH) scheme as the image heat generation section. As shown in FIG. 2, the fixing apparatus 200 is provided with the fixing roller 210, the heat generating roller 220 as a heat generating body and the fixing belt 230 as an image heating body, etc. Furthermore, the fixing apparatus 200 is also provided with a pressurizing roller 240, an induction heating apparatus 250 as a heat generation section, a separator 260 as a sheet separation guide plate and sheet guide plates 281, 282, 283, 284 as sheet transfer route formation members, etc.

The fixing apparatus 200 heats the heat generating roller 220 and fixing belt 230 through an action of a magnetic field generated by the induction heating apparatus 250. The fixing apparatus 200 heats and fixes the unfixed image on the recording paper P transferred along the sheet guide plates 281, 282, 283, 284 through the fixing nip section N between the heated fixing belt 230 and pressurizing roller 240.

The fixing apparatus using the image heating apparatus according to this Embodiment 1 may also be constructed in such a way that the fixing roller 210 also serves as the heat generating roller 220 and this fixing roller 210 directly heats and fixes the unfixed image on the recording paper P without using the fixing belt 230.

In FIG. 2, the heat generating roller 220 is constructed of a body of rotation made of a hollow cylindrical magnetic metal member such as iron, cobalt, nickel or an alloy of these metals, etc. The heat generating roller 220 are supported at both ends in a rotatable manner by bearings fixed to support side plates (not shown) and rotated/driven by a driving section (not shown). Furthermore, the heat generating roller 220 has a structure with an outer diameter of 20 mm, a thickness of 0.3 mm, a low heat capacity, a quick temperature rise and adjusted to have a Curie point of 300° C. or more.

The fixing roller 210 consists of a core metal made of stainless steel, etc., coated with a solid or foaming and heat-resistant elastic member made of silicon rubber. The fixing roller 210 has an outer diameter of approximately 30 mm which is greater than the outer diameter of the heat generating roller 220. The elastic member has a thickness of approximately 3 to 8 mm and hardness of 15 to 50° (Asker hardness: 6 to 25° according to JIS A hardness).

Furthermore, the pressurizing roller 240 contacts the fixing roller 210 under pressure. This contact under pressure between the fixing roller 210 and pressurizing roller 240 causes a fixing nip section N of a predetermined width to be formed in the pressure contact area.

The fixing belt 230 consists of a heat-resistant belt put round between the heat generating roller 220 and fixing roller 210. With the heat generating roller 220 induction-heated by the induction heating apparatus 250, which will be described later, the heat of the heat generating roller 220 is transmitted to the fixing belt 230 in the contact area and the total circumference of the belt is heated as the heat generating roller 220 rotates.

In the fixing apparatus 200 structured as above, since the heat capacity of the heat generating roller 220 is smaller than the heat capacity of the fixing roller 210, the heat generating roller 220 is heated rapidly and this shortens the warm-up time at the start of heating and fixing.

The fixing belt 230 is constructed of a heat-resistant belt having a multilayered structure consisting of a heat generating layer, elastic layer and mold release layer. The heat generating layer uses as abase material, for example, magnetic metal such as iron, cobalt, nickel or an alloy using those metals as base materials. The elastic layer is made of an elastic member such as silicon rubber or fluorine rubber provided so as to cover the surface of the heat generating layer. The mold release layer is formed of resin or rubber with excellent mold-releasing properties such as PTFE, PFY, FEP, silicon rubber or fluorine rubber singly or as a mixture thereof.

Even if a foreign matter enters between the fixing belt 230 and heat generating roller 220 for some reason and a gap is produced there, the fixing belt 230 structured as above can induction-heat the heat generating layer through the induction heating apparatus 250 and heat the fixing belt itself. Thus, the fixing belt 230 can directly heat itself through the induction heating apparatus 250, which improves the heating efficiency, increases the speed of response and improves reliability as the heating/fixing section with a reduced temperature variation.

The pressurizing roller 240 is constructed of a heat-resistant elastic member with high toner mold-releasing properties provided on the surface of a metal core made of a highly thermal conductive, metallic cylindrical member of copper or aluminum, etc. As the core metal, SUS may also be used in addition to the above described metals.

As described above, the pressurizing roller 240 forms the fixing nip section N which carries the recording paper P sandwiched through its pressure contact with the fixing roller 210 by the medium of the fixing belt 230. In the fixing apparatus 200 shown in the figure, the fixing nip section N is formed by making the pressurizing roller 240 harder than the fixing roller 210 so that the outer surface of the pressurizing roller 240 is pressed into the outer surface of the fixing roller 210 by the medium of the fixing belt 230.

For this reason, though the outer diameter the pressurizing roller 240 is approximately 30 mm, the same as that of the fixing roller 210, the thickness is approximately 2 to 5 mm, which is thinner than the fixing roller 210 and has hardness of approximately 20 to 600 (Asker hardness: 6 to 25° according to JIS A hardness), which is harder than the fixing roller 210.

In the fixing apparatus 200 structured as above, the recording paper P is carried sandwiched by the fixing nip section N so as to move along the surface shape of the outer surface of the pressurizing roller 240, which produces the effect that the heating/fixing surface of the recording paper P is likely to separate from the surface of the fixing belt 230.

A temperature detector 270 made of a thermo-sensitive device with quick thermal response such as a thermistor is placed in contact with the inner surface of the fixing belt 230 in the vicinity of the entrance of the fixing nip section N as a temperature detection section.

The induction heating apparatus 250 performs control based on the temperature of the inner surface of the fixing belt 230 detected by the temperature detector 270 in such a way that the heating temperature of the heat generating roller 220 and fixing belt 230, that is, the image fixing temperature of the unfixed image is kept to a predetermined temperature.

Next, the configuration of the induction heating apparatus 250 will be explained. As shown in FIG. 2, the induction heating apparatus 250 is disposed so as to face the outer surface of the heat generating roller 220 by the medium of the fixing belt 230. The induction heating apparatus 250 is provided with a support frame 251 made of flame-retardant resin which is curved so as to cover the heat generating roller 220 as a coil guide member.

In the central part of the support frame 251, a thermostat 252 is disposed in such a way that the temperature detection section is partially exposed from the support frame 251 toward the heat generating roller 220 and fixing belt 230.

When the temperature of the heat generating roller 220 and fixing belt 230 is detected to have reached an abnormally high temperature, the thermostat 252 forcibly breaks the connection between an excitation coil 253 wound around the outer surface of the support frame 251 as a magnetic field generation section and an inverter circuit (not shown).

The excitation coil 253 is constructed of one long surface-insulated excitation coil wire wound alternately along the support frame 251 in the axial direction of the heat generating roller 220. The length of the winding of the excitation coil 253 is set to be substantially the same as the length of the area where the fixing belt 230 contacts the heat generating roller 220.

The excitation coil 253 is connected to the inverter circuit (not shown) to generate an alternating magnetic field by being supplied with a high-frequency alternating current of 10 kHz to 1 MHz (preferably 20 kHz to 800 kHz) This alternating magnetic field acts on the heat generating layers of the heat generating roller 220 and fixing belt 230 in the contact area between the heat generating roller 220 and fixing belt 230 and in the vicinity thereof. The action of this alternating magnetic field causes an eddy current to flow inside the heat generating layer of the fixing belt 230 in a direction preventing any variation of the alternating magnetic field.

This eddy current produces Joule heat according to the resistance of the heat generating layers of the heat generating roller 220 and fixing belt 230 and principally induction-heats the heat generating roller 220 and fixing belt 230 in the contact area between the heat generating roller 220 and fixing belt 230 and in the vicinity thereof.

On the other hand, the support frame 251 is provided with an arch core 254 and a side core 255 so as to surround the excitation coil 253. These arch core 254 and side core 255 increase inductance of the excitation coil 253 and improves electromagnetic coupling between the excitation coil 253 and heat generating roller 220.

Therefore, the actions of the arch core 254 and side core 255 of this fixing apparatus 200 allow even a same coil current to supply more power to the heat generating roller 220 and can shorten the warm-up time.

Furthermore, the support frame 251 is provided with a roof-shaped resin housing 256 formed so as to cover the arch core 254 and thermostat 252 inside the induction heating apparatus 250. A plurality of heat radiation holes are formed in this housing 256 so that heat generated from the support frame 251, excitation coil 253 and arch core 254, etc., radiates out. The housing 256 may also be formed of any material other than resin such as aluminum.

Furthermore, the support frame 251 is provided with a short ring 257 that covers the outer surface of the housing 256 in such a way as not to block the heat radiation holes formed in the housing 256. The short ring 257 is disposed on the back of the arch core 254. In the short ring 257, an eddy current is generated in a direction canceling slight leaked magnetic flux which leaks outward from the back of the arch core 254, producing a magnetic field in a direction canceling the magnetic field of the leaked magnetic flux to thereby prevent unnecessary radiation.

Figure 3:
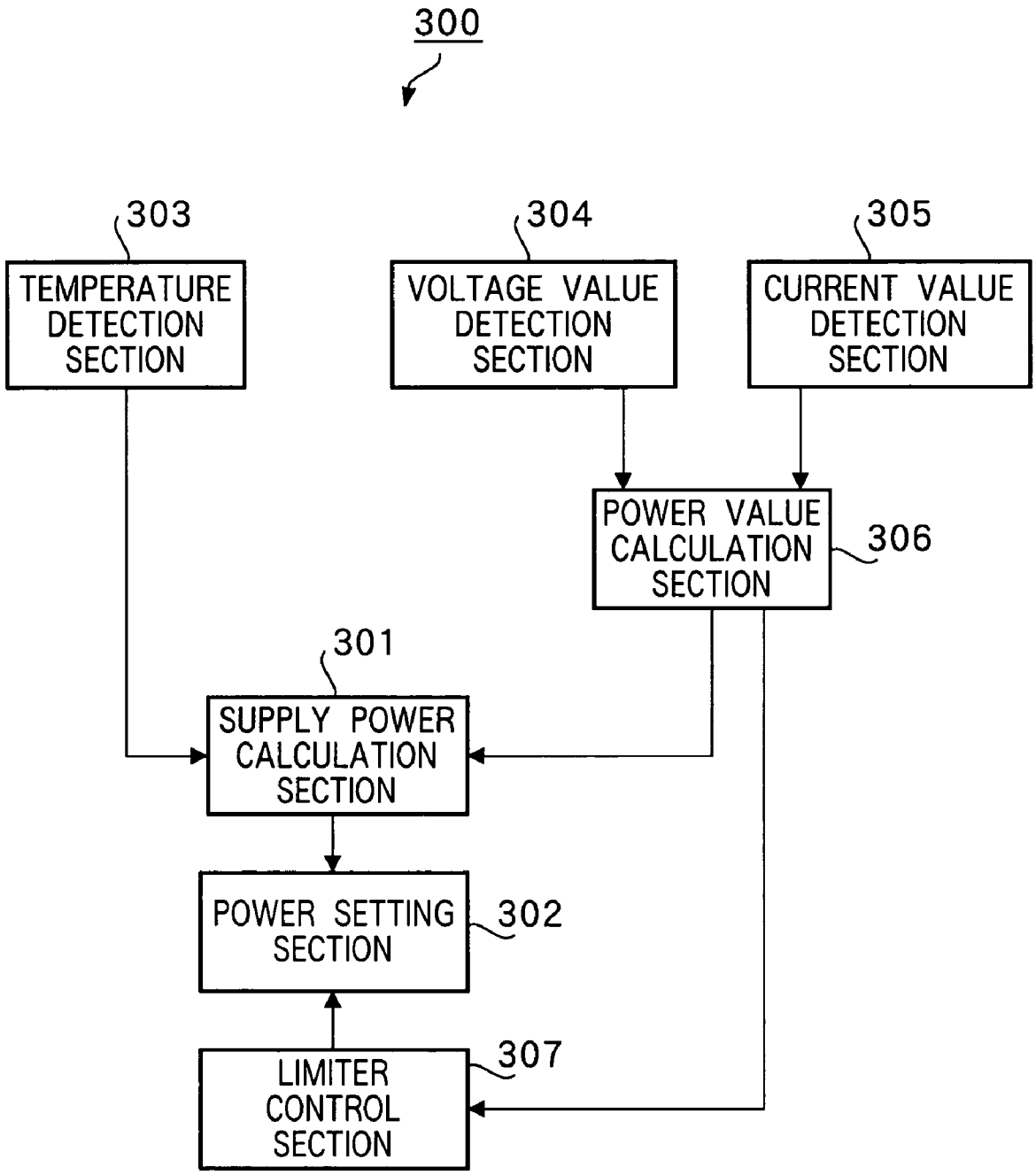
FIG. 3 is a block diagram showing the configuration of a the heat value control section of the fixing apparatus according to Embodiment 1.

Next, the configuration and function of a heat value control section of the fixing apparatus 200 using the image heating apparatus according to this Embodiment 1 will be explained. FIG. 3 is a block diagram showing the configuration of the heat value control section 300 as the IH control section of the fixing apparatus 200.

As shown in FIG. 3, the heat value control section 300 is provided with a supply power calculation section 301, a power setting section 302, a temperature detection section 303, a voltage value detection section 304, a current value detection section 305, a power value calculation section 306 and a limiter control section 307, etc.

When a printing operation start command is sent from a host (not shown) (personal computer used by the user, etc.), the image formation apparatus 100 starts the aforementioned image formation operation. This causes the induction heating apparatus 250 of the fixing apparatus 200 to heat the heat generating roller 220 and fixing belt 230 in order to heat and fix an unfixed full color image secondary-transferred to the recording paper P through the image formation operation.

In FIG. 3, the supply power calculation section 301 calculates an amount of power to be given to the induction heating apparatus 250 that heats the heat generating roller 220 and fixing belt 230 of the fixing apparatus 200.

The power setting section 302 outputs the power value data calculated by the supply power calculation section 301 to an inverter circuit (not shown) that drives the excitation coil 253.

According to the value (register value) set in this power setting section 302, the power value to be output to the inverter circuit is controlled. Controlling this power value allows the heat value of the induction heating apparatus 250 and temperatures of the heat generating roller 220 and fixing belt 230 for fixing an unfixed image to the recording paper P to be controlled.

Information necessary to calculate power supplied to the induction heating apparatus 250 includes the image fixing temperature of the fixing apparatus 200 and power value actually supplied to the inverter circuit. The temperature of the fixing apparatus 200 is obtained from the temperature detection section 303. The power value actually supplied to the inverter circuit is obtained from the power value calculation section 306.

The temperature detection section 303 converts an analog output from the temperature detector 270 disposed in contact with the inner surface of the fixing belt 230 in the vicinity of the entrance of the fixing nip section N to digital data through an AD converter and inputs the digital data to the supply power calculation section 301.

The power value calculation section 306 adopts a method of calculating the power value by multiplying the output of the voltage value detection section 304 that detects the input voltage value of the inverter circuit by the output of the current value detection section 305 that detects the input current value from the inverter circuit.

The voltage value detection section 304 AD-converts the input voltage value of the inverter circuit and gives the digital data to the supply power calculation section 301. The current value detection section 305 AD-converts the input voltage value of the inverter circuit and gives the digital data to the supply power calculation section 301. With regard to the current value, it is also possible to detect the current value that flows through the excitation coil 253 and use the current value for control.

The supply power calculation section 301 periodically (here, every 10 ms) acquires data from the temperature detection section 303 and data from the power value calculation section 306 and sets the calculated value (register value) in the power setting section 302. Thus, the supply power calculation section 301 sets the calculated values in the power setting section 302 and thereby controls the temperatures of the heat generating roller 220 and fixing belt 230 for fixing the unfixed image to the recording paper P.

The limiter control section 307 plays the role of finally checking power to be set in the power setting section 302. That is, when a value exceeding a predetermined default limit value is about to be set in the power setting section 302 or when the data in the power value calculation section 306 is a value greater than a predetermined default value, the limiter control section 307 has the function of performing control so as to rewrite the data to be set in the power setting section 302 to a default value.

More specifically, when, for example, the limit value is data AA (hexadecimal) HEX and the value calculated by the supply power calculation section 301 is equal to or greater than AAHEX, the limiter control section 307 forcibly sets power corresponding to 80% of the target power as the value to be set in the power setting section 302. Furthermore, when the data from the power value calculation section 306 is, for example, equal to or greater than 1150 W, the limiter control section 307 also carries out similar processing.

When the power is set, the power is actually gated by an upper limit value and lower limit, and therefore the power will actually not exceed or fall below the aforementioned limit values. However, it should be noted that such limit control is necessary also in the sense of preparing for a case where noise is generated on an AD converter line to acquire a current value and voltage value and data is erroneously detected.

Next, various states of the control operation of the fixing apparatus 200 for fixing the unfixed image to the recording paper P and transition condition will be explained.

Figure 4:
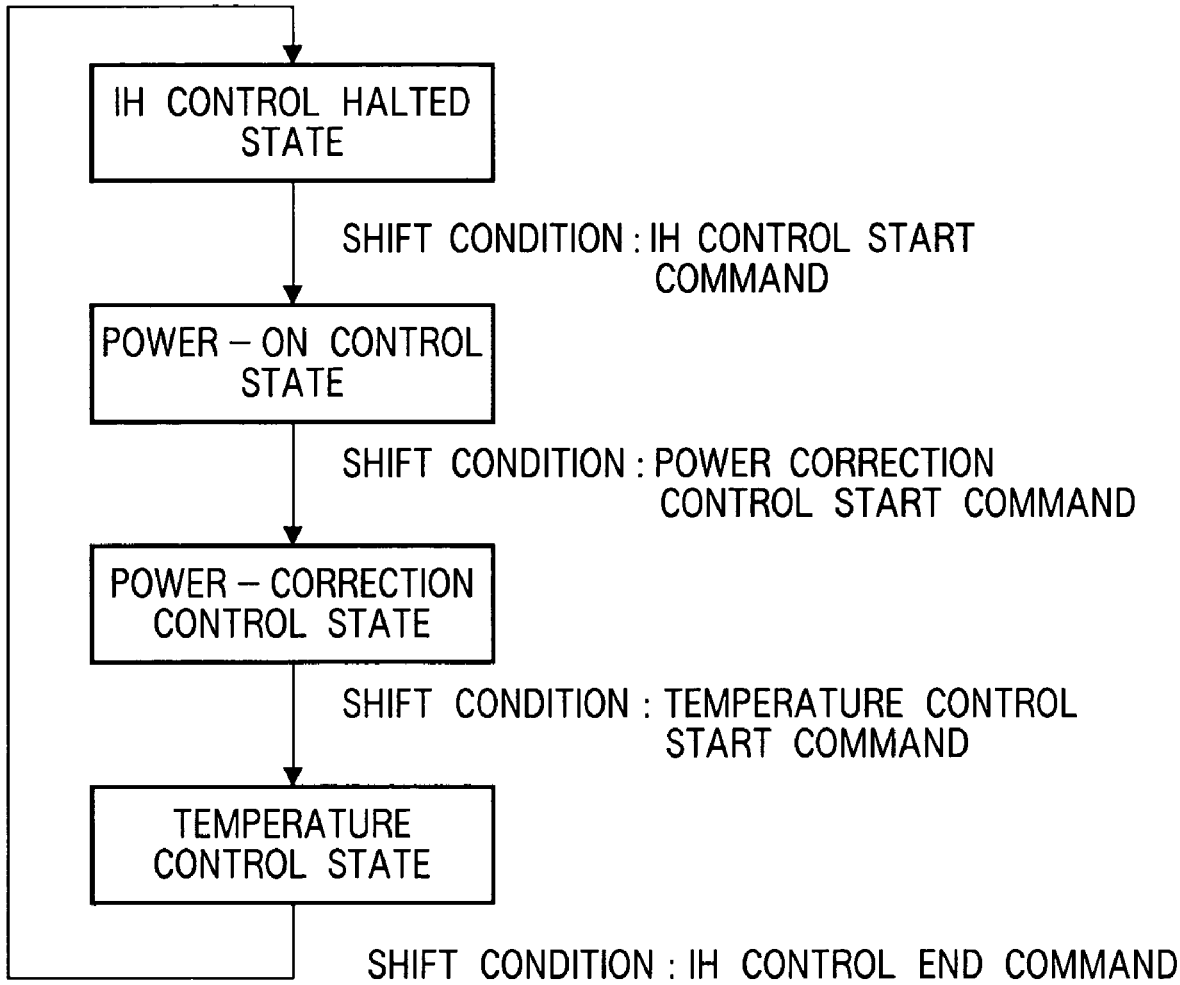
FIG. 4 is a control state transition diagram of the fixing apparatus corresponding to Embodiment 1.

FIG. 4 is a control state transition diagram of the heat value control section 300 of the fixing apparatus 200 using the image heating apparatus according to this Embodiment 1. Here, an overview of the operation of the heat value control section 300 of the fixing apparatus 200 will be explained. Details will be explained using operation flow charts of the respective states.

In FIG. 4, when the image formation apparatus 100 is waiting for a print request, the heat value control section 300 normally stops energization to the inverter circuit (hereinafter referred to as "IH control halting state"). However, when it is desirable to shorten a first printing time, this image formation apparatus 100 needs to preheat the heat generating roller 220 and fixing belt 230 of the fixing apparatus 200 to a certain temperature, for example, approximately 100° C. In this case, the heat value control section 300 applies power smaller than the power applied to heat and fix an unfixed image to the recording paper P to the inverter circuit.

When the image formation apparatus 100 receives a print start command, a command for start of energization to the inverter circuit is issued to the heat value control section 300 of the fixing apparatus 200 (hereinafter referred to as "IH control start state"). Before control for increasing the temperature of the heat generating roller 220 and fixing belt 230 of the fixing apparatus 200 up to a temperature at which an unfixed image can be fixed to the recording paper P is started, a process for preparations therefor is carried out first (hereinafter referred to as "power-on control state").

In this power-on control state, the heat value control section 300 checks a signal for carrying out energization to the inverter circuit, for example, check on whether a zero-cross signal, etc., is normally input or not or check on whether energization to the inverter circuit is carried out normally or not.

The zero-cross signal is periodically input to the heat value control section 300 of the fixing apparatus 200 as an interrupt signal and it is decided whether the signal is normal or not by measuring this period, high-state time and low-state time.

Here, there is an error indicating that the period is abnormal, etc., the heat value control section 300 stops the IH control operation. Furthermore, when the period is normal, the heat value control section 300 sets data (lower limit) to be set first after the IH control is started in the power setting section 302. This lower limit is a value which differs depending on the supply voltage and a minimum settable value is stored in a ROM (not shown) as predetermined data from the standpoint of protecting the inverter circuit.

After a lapse of a default time (here, 300 ms) after the lower limit is set, the heat value control section 300 checks how much power is actually applied to the value set in the power setting section 302 with reference to the data from the power value calculation section 306 to thereby check whether power corresponding to the lower limit has been applied or not.

For example, when the supply voltage is 100 V, if the lower limit data is 70HEX (hexadecimal data) and the corresponding power is 500 W, the heat value control section 300 sets 70HEX in the power setting section 302. Then, when the data of the power value calculation section 306 after 300 ms is extremely smaller than 500 W (here, default is 200 W), the heat value control section 300 sets the lower limit in the power setting section 302 again and checks the data of the power value calculation section 306 after a default time. When this retry operation is repeated a default number of times (here, 5 times) or more, the heat value control section 300 considers it as an error and stops IH control.

Here, if the first power is applied normally, then it is necessary to set power for the second time. The data to be set for the second time is determined depending on how much power is applied to the data set for the first time.

For example, if the actual power is 450 W as opposed to the case where a theoretical value when 70HEX is set in the power setting section 302 is 500 W, it is smaller than the theoretical value, and therefore, for example, 80HEX is set in the power setting section 302 for the second time. On the contrary, if the actual power is 550 W, it is a value greater than the theoretical value, and therefore 78HEX which is smaller than 80HEX is set in the power setting section 302 for the second time.

The power setting in the power setting section 302 is repeated using the same method and continued until the setting reaches the target power. There is also a method of determining data to be set from the second time onward according to the difference between the actual power and target power value. The target power value is a value that specifies maximum applicable power which can make the first printing time as short as possible at a level at which the inverter circuit is not destroyed.

In this way, when the actual power reaches the above described target power after a plurality of power settings is performed, the control state shifts to a state for keeping the power close to the target power value (hereinafter this will be referred to as "power correction control state"). Here, control to keep the target power is performed while incrementing/decrementing the power set value in the power setting section 302 at one level.

More specifically, if the target power is 909 W, when the actual power when 90HEX is set in the power setting section 302 is 915 W in the data from the power value calculation section 306, 8FHEX which is a value obtained by subtracting one level is set in the power setting section 302.

Then, if the actual power at this time is data from the power value calculation section 306 and is a value lower than 909 W, 90HEX obtained by adding one level to 8FHEX is set in the power setting section 302 next. Furthermore, if the actual power has a value greater than 909W, 8EHEX which is a value obtained by further subtracting one level from 8FHEX is set in the power setting section 302.

This power correction control is continued until a temperature control shift command is issued. The maximum set value set during this power correction control is stored as an upper limit value and used in subsequent temperature control, etc.

When such power correction control is executed, the temperature of the fixing belt 230 of the fixing apparatus 200 increases. When the temperature of the fixing belt 230 of this fixing apparatus 200 reaches a predetermined default temperature (here, a value lower than the fixing set temperature of an unfixed image by 20° C.), the power correction control is halted. Then, a temperature control shift command for executing temperature control (temperature control state) relative to an image fixing temperature is issued to the heat value control section 300 of the fixing apparatus 200 from the image formation apparatus 100 this time.

This temperature control is performed by so-called PID control (details will be given later) using a difference between the temperature of the fixing belt 230 of the fixing apparatus 200 and fixing set temperature of the unfixed image, integral value thereof or derivation value. In this PID control, the data value to be set in the power setting section 302 is calculated by the supply power calculation section 301 and the calculated value is set in the power setting section 302 at default time intervals (here, 10 ms).

Unlike power control, this temperature control performs control relative to the temperature of the fixing belt 230 of the fixing apparatus 200. If the power setting section 302 is assumed to be, for example, an 8-bit register, the allowable range of the value of the calculation result of temperature control is 0 to 255 (8-bit upper limit).

However, if the calculation result of the temperature control is set in the power setting section 302, the heat value control section 300 of this fixing apparatus 200 sets a value smaller than the above described lower limit or a value greater than the upper limit value in the power setting section 302, producing a danger of destroying the inverter circuit.

To prevent this, as the power setting during temperature control, only a value between the upper limit value and lower limit is set in the power setting section 302. Here, when the calculation result of temperature control is greater than the upper limit value, the upper limit value is set in the power setting section 302 and when the calculation result of temperature control is smaller than the lower limit, the lower limit is set in the power setting section 302.

However, if the heat value control section 300 of this fixing apparatus 200 continues to set the lower limit in the power setting section 302, since a value smaller than the lower limit is originally required, there is a possibility that the temperature control may fail. Thus, the heat value control section 300 of this fixing apparatus 200 performs PWM control in accordance with the ratio of the lower limit to calculated value as a countermeasure.

More specifically, when the lower limit is assumed to be 40HEX, if the calculated value is 20HEX, PWM control of duty 50% is performed. This series of temperature control states is continued until an IH control end command by a printing stop request, etc., is received. Then, the heat value control section 300 shifts to an IH control halted state and the fixing apparatus 200 returns to the IH control start command waiting state.

For the heat value control section 300 to perform the above described IH control, the aforementioned various types of data need to be acquired and referenced. Next, the method of acquiring various types of data for performing the IH control will be explained.

Data necessary for the IH control includes the following data:

(1) Power supply frequency
(2) Current value and voltage value input to the inverter circuit and power value calculated by multiplying these values
(3) Target power value
(4) Minimum power value
(5) Limit power value
(6) Lower limit register value
(7) Limit value register value
(8) Temperature of fixing apparatus (plurality of locations)

Since the upper limit value is calculated when power correction control is executed, it will be explained in the section of a description of operation of power correction control.

First, (1) the method of measuring a power supply frequency will be explained. When the power to the image formation apparatus 100 is turned ON, the input of a zero-cross signal is started. This zero-cross signal is notified to the heat value control section 300 as an interrupt signal of a CPU (Central Processing Unit) (not shown).

With regard to CPU interrupts, it is possible to specify interrupt disabled/interrupt enabled and interrupt is disabled when power is turned ON. Thus, this image formation apparatus 100 specifies interrupt enabled after power is turned ON to enable the interrupt and allow a zero-cross signal to be input to the heat value control section 300.

When the zero-cross signal is input, the heat value control section 300 starts a timer to measure the time until the next zero-cross signal is input, that is, an interrupt is generated. The heat value control section 300 decides the power supply frequency (50 Hz/60 Hz) from this measured time. The zero-cross period is 20 ms for 50 Hz and 16.7 ms for 60 Hz. Therefore, the heat value control section 300 of this fixing apparatus 200 takes into consideration the delay and variation, etc., of an interrupt generation time and sets 18 ms as a threshold and specifies 50 Hz for the zero-cross period greater than that and 60 Hz for the zero-cross period smaller than that.

Next, (2) the current value and voltage value input to the inverter circuit and the method for acquiring a power value by the power value calculation section 306 using a multiplication of these values will be explained. FIG. 5 illustrates a method of acquiring current values and voltage values calculated by the power value calculation section 306.

As shown in FIG. 5, the expressions for acquiring actual current values and voltage values vary depending on the supply voltage system and power supply frequency. The supply voltage system referred to here detects whether the image formation apparatus 100 is connected to a 100 V-based power supply or 200 V-based power supply using a low-voltage power supply (not shown) and notifies it to the heat value control section 300.

As shown in FIG. 5, the actual current value Ival input to the inverter circuit and AD-converted digital data ADi have a linear relationship and their coefficients are experimentally obtained. Furthermore, the actual voltage value Vval input to the inverter circuit and AD-converted digital data ADv have a linear relationship likewise and their coefficients are also experimentally obtained.

For example, the voltage value input to the inverter circuit for a 100 V system at 50 Hz is obtained by:

$$Vval=0.7112\times ADv-33.0290[volt] \quad \text{Expression 5-1}$$

The current value input to the inverter circuit for a 100 V system, 50 Hz is obtained by:

$$Ival=0.0533\times ADi-1.5059[amp] \quad \text{Expression 5-2}$$

The voltage value input to the inverter circuit for a 100 V system at 60 Hz is obtained by:

$$Vval=0.7148\times ADv-33.1930[volt] \quad \text{Expression 5-3}$$

The current value input to the inverter circuit for a 100 V system at 60 Hz is obtained by:

$$Ival=0.0535\times ADi-1.6145[amp] \quad \text{Expression 5-4}$$

The voltage value input to the inverter circuit for a 200 V system at 50 Hz is obtained by:

$$Vval=1.4048\times ADv-63.7730[volt] \quad \text{Expression 5-5}$$

The current value input to the inverter circuit for a 200 V system at 50 Hz is obtained by:

$$Ival=0.0269\times ADi-0.8516[amp] \quad \text{Expression 5-6}$$

The voltage value input to the inverter circuit for a 200 V system at 60 Hz is obtained by:

$$Vval=1.4048\times ADv-63.7730[volt] \quad \text{Expression 5-7}$$

The current value input to the inverter circuit for a 200 V system at 60 Hz is obtained by:

$$Ival=0.0268\times ADi-0.9182[amp] \quad \text{Expression 5-8}$$

Furthermore, the power value supplied to the inverter circuit is calculated by multiplying the current value and voltage value calculated using each of the above described Expressions at the power value calculation section 306. This fixing apparatus 200 can respond to a voltage variation, etc., in real time by repeating these calculations at the power value calculation section 306 at 10 ms intervals and realizes IH control with higher reliability.

Next, the method of acquiring (3) a method of acquiring a target power value implemented by the heat value control section 300 will be explained. This target power value is set from the standpoints of reduction of a first printing time which is one of performance items of the image formation apparatus 100 and protection of the inverter circuit.

That is, for this image formation apparatus 100, increasing the target power value is advantageous for the first printing time but may cause destruction of the inverter circuit. On the contrary, decreasing the target power value is preferable from the standpoint of protection of the inverter circuit, but this involves a danger of delaying the first printing time. Therefore, this target power value is experimentally determined by a tradeoff between the two standpoints. FIG. 6 illustrates a method of acquiring the target power value implemented by the heat value control section 300.

Figure 6A:
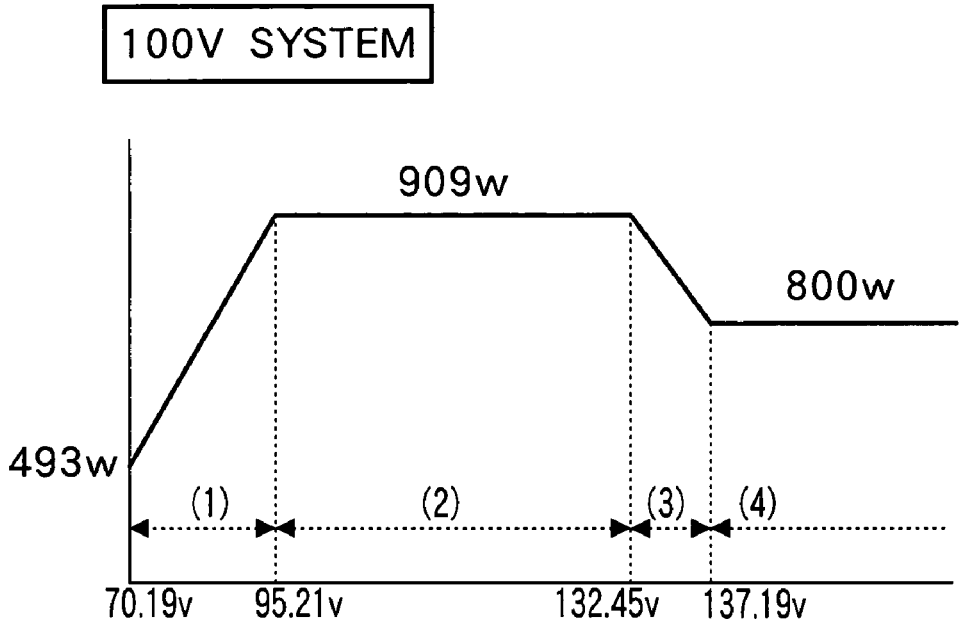
FIG. 6A illustrates a method of acquiring a target power value when the image formation apparatus corresponding to Embodiment 1 is connected to a 100 V-based power supply.

As shown in FIG. 6A, when the image formation apparatus 100 is connected to a 100 V-based power supply, the target power value of section (1) (supply voltage ranges from 70.19 V to 95.21 V) is calculated by:

$$16.39\times \text{supply voltage}-651.1960[W] \quad \text{Expression 6-1}$$

The target power value of section (2) (supply voltage ranges from 95.21 V to 132.45 V) is calculated by:

$$909[W] \quad \text{Expression 6-2}$$

and is constant.

The target power value of section (3) (supply voltage ranges from 132.45 V to 137.19 V) is calculated by:

$$-22.94\times \text{supply voltage}+3947.1190[W] \quad \text{Expression 6-3}$$

The target power value of section (4) (supply voltage is equal to or higher than 137.19 V) is calculated by:

$$800[W] \quad \text{Expression 6-4}$$

and is constant. In section (4), the minimum power which will be described later is also the same value.

Figure 6B:
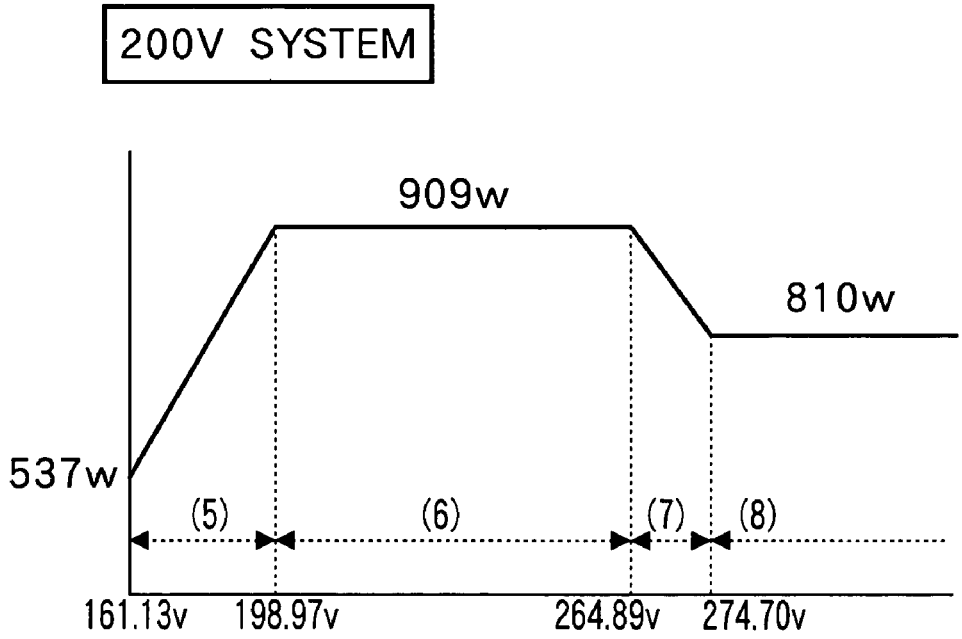
FIG. 6B illustrates a method of acquiring a target power value when the image formation apparatus corresponding to Embodiment 1 is connected to a 200 V-based power supply.

Furthermore, as shown in FIG. 6B, when the image formation apparatus 100 is connected to a 200 V-based power supply:

The target power value of section (5) (supply voltage ranges from 161.13 V to 198.97 V) is calculated by:

$$9.83\times \text{supply voltage}-1047.0476[W] \quad \text{Expression 6-5}$$

The target power value of section (6) (supply voltage ranges from 198.97 V to 264.89 V) is calculated by:

$$909[W] \quad \text{Expression 6-6}$$

and is constant.

The target power value of section (7) (supply voltage ranges from 264.89 V to 274.70 V) is calculated by:

$$-9.84\times \text{supply voltage}+3513.0034[W] \quad \text{Expression 6-7}$$

The target power value of section (8) (supply voltage is equal to or higher than 274.70 V) is calculated by:

$$810[W] \quad \text{Expression 6-8}$$

and is constant. In this section (8), the minimum power which will be described later is also the same value.

In this way, the heat value control section 300 of this fixing apparatus 200 sets an optimum target power value for each voltage from the standpoint of protection of the inverter circuit or from the standpoint of securing the first printing time. In this way, by repeating acquisition of target power values at 10 ms intervals, this heat value control section 300 can respond to a voltage variation, etc., in real time and implement IH control with higher reliability.

Next, the method of acquiring (4) a minimum power value implemented by the heat value control section 300 will be explained. This minimum power is set from the standpoint of protection of the inverter circuit. As described above, when high power is given to the inverter circuit or power small than a certain value is given, the inverter circuit may be destroyed.

FIG. 7 illustrates the method of acquiring a minimum power value implemented by the heat value control section 300. As shown in the 100 V system in FIG. 7A and the 200 V system in FIG. 7B, the minimum power value is variable depending on the supply voltage. The heat value control section 300 can also respond to a voltage variation, etc., by acquiring a minimum power value in 10 ms intervals and realize IH control with higher reliability.

The smaller the minimum power value, the higher the control performance of temperature control by the fixing apparatus 200, that is, the control dynamic range becomes wider and controllability improves, but this may lead to destruction of the inverter circuit on the other hand. Therefore, this minimum power value is experimentally determined by a tradeoff between the two as in the case of the above described target power.

Next, (5) the method of acquiring a limit power value implemented by the heat value control section 300 will be explained. This limit power value is specified with a power value of target power+250 W.

With respect to the temperature of the fixing apparatus 200, since power is normally controlled with the target power value, the power supplied to the inverter circuit must not reach limit power. This limit power value is provided to guarantee the operation against disturbances such as when the heat value control section 300 causes misoperation due to noise, etc., and AD-converted values of a current value and voltage value become irregular values.

That is, when the power supplied to the inverter circuit is detected to be equal to or higher than the limit power, the heat value control section 300 controls the power set value so that the supply power becomes a value smaller than the target power (e.g., power value of 80% of target power). This can prevent problems with destruction of the inverter circuit and IH control due to misoperation of the inverter circuit.

Figure 8A:
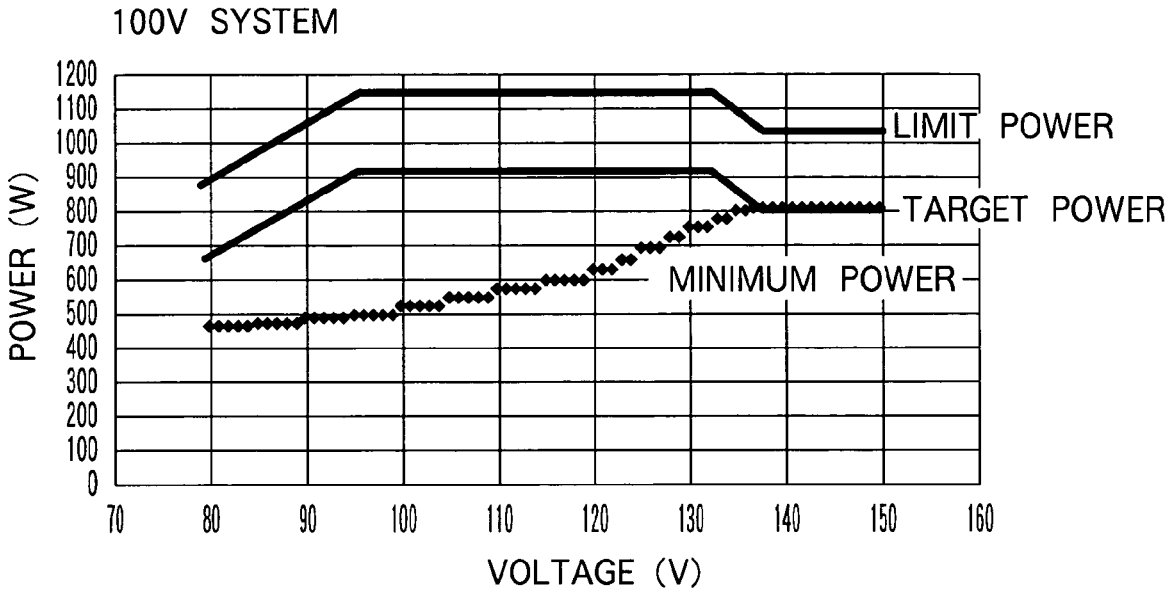
FIG. 8A illustrates a relationship between a target power value, minimum power value and limit power value when the image formation apparatus corresponding to Embodiment 1 is connected to a 100 V-based power supply.
Figure 8B:
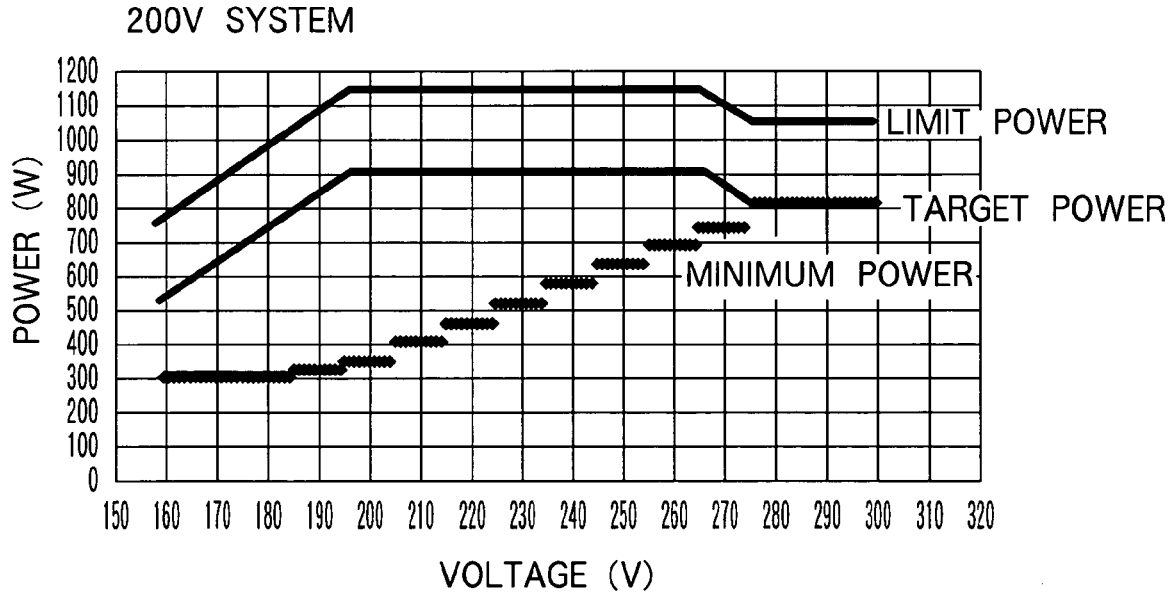
FIG. 8B illustrates a relationship between a target power value, minimum power value and limit power value when the image formation apparatus corresponding to Embodiment 1 is connected to a 200 V-based power supply.

FIG. 8A and FIG. 8B illustrate a relationship between a target power value, minimum power value and limit power value in the 100 V system and 200 V system. As shown in FIGS. 8A and 8B, target power+250[W] is set as limit power for both the 100 V system and 200 V system. Furthermore, in FIGS. 8A and 8B, the minimum power values shown in FIGS. 7A and 7B are plotted on a graph as their minimum power.

Next, (6) the method of acquiring a lower limit register value implemented by the heat value control section 300 will be explained. FIG. 9A and FIG. 9B illustrate the method of acquiring lower limit data in the 100 V system and 200 V system. The lower limit data refers to a register value corresponding to the minimum power value. This lower limit data is minimum power 525 W when the supply voltage is 100 V, for example, as shown in FIG. 7A.

On the other hand, the lower limit data when the supply voltage is 100 V is calculated as 77 (decimal) by Expression 9-6 shown in FIG. 9A. For actual IH control, this register value is used instead of the power value (expressed in W) shown in FIG. 7A.

Though the lower limit data and power value (in W) are uniquely determined, they may vary slightly due to inductance variations of the excitation coil 253 and fixing apparatus 200 and actual use.

Therefore, in this fixing apparatus 200, the heat value control section 300 always feeds back the power from the current value and voltage value input to the inverter circuit after setting power at various phases of IH control including the lower limit data. This causes the fixing apparatus 200 to cancel the variation factors and realize IH control with higher reliability.

The lower limit register value is variable depending on the supply voltage and is calculated by a quadratic relational expression with the supply voltage. Coefficients of this quadratic relational expression are experimentally determined taking into account inductance variations of the fixing apparatus 200 and excitation coil 253.

More specifically, the coefficients are determined from data such as the maximum value and minimum value in the parts specifications of the fixing apparatus 200 and excitation coil 253 and values close to their average. By acquiring the lower limit register value at 10 ms intervals, this fixing apparatus 200 can respond to voltage variations, etc., in real time and realize IH control with higher reliability.

Next, (7) the method of acquiring the limit value register value implemented by the heat value control section 300 will be explained. This limit value register value corresponds to register data corresponding to the limit power value obtained basically by applying the same experiment as the experiment whereby the lower limit data is calculated with respect to the minimum power value.

Since data of the fixing apparatus 200 is normally limited by an upper limit value in the power setting during IH control, the power set value will never reach the limit value. However, as described above, the upper limit value calculated during power correction control may exceed limit values due to inductance variations of the excitation coil 253 and fixing apparatus 200 and secular variations due to actual use.

That is, the heat value control section 300 of this fixing apparatus 200 increments the power settings so as to achieve the target power during the power correction control. However, when the inductances of the excitation coil 253 and fixing apparatus 200 deviate from the parts specification values due to secular variations, etc., the power set value may not reach the target power no matter how much the power set value may be increased, that is, it becomes difficult to turn ON power, which leads to a situation in which the power set value will increase permanently.

Such an increase of the power set value is not desirable from the standpoint of protection of the inverter circuit, and therefore it is necessary to provide a final limit value. Thus, the heat value control section 300 controls the power set value so that when the power set value exceeds the limit value, the supply power becomes a smaller value (e.g., power value of 80% of target power). This prevents trouble with IH control due to destruction of the inverter circuit and misoperation of the inverter circuit. By repeating the operation of acquiring this limit value register value at intervals of 10 ms, the heat value control section 300 of this fixing apparatus 200 realizes IH control with higher reliability so as to respond to a voltage variation, etc., in real time.

Next, (8) the method of acquiring the temperature of the fixing apparatus implemented by the temperature detection section 303 will be explained. This fixing apparatus 200 detects the temperature at two locations using the temperature detector 270. One is the central part of the fixing apparatus 200 and the other is an end of the fixing apparatus 200. The purpose of a temperature detection in the central part of the fixing apparatus 200 is to fix an unfixed image on the recording paper P at an optimum image fixing temperature and secure the image quality. The purpose of a temperature detection at the end of the fixing apparatus 200 is to detect an abnormal temperature rise at a non-paper-passage section (end) of the fixing apparatus 200 when small size sheets are printed successively and cool down them.

The respective detected temperatures of the temperature detector 270 which detects various parts of the fixing apparatus 200 are acquired through the AD converter in the temperature detection section 303 and given to the supply power calculation section 301 as digital data. The temperature data of the fixing apparatus 200 is acquired by this temperature detection section 303 at 10 ms intervals and used for a temperature control calculation and error detection of the fixing apparatus 200.

Figure 10:
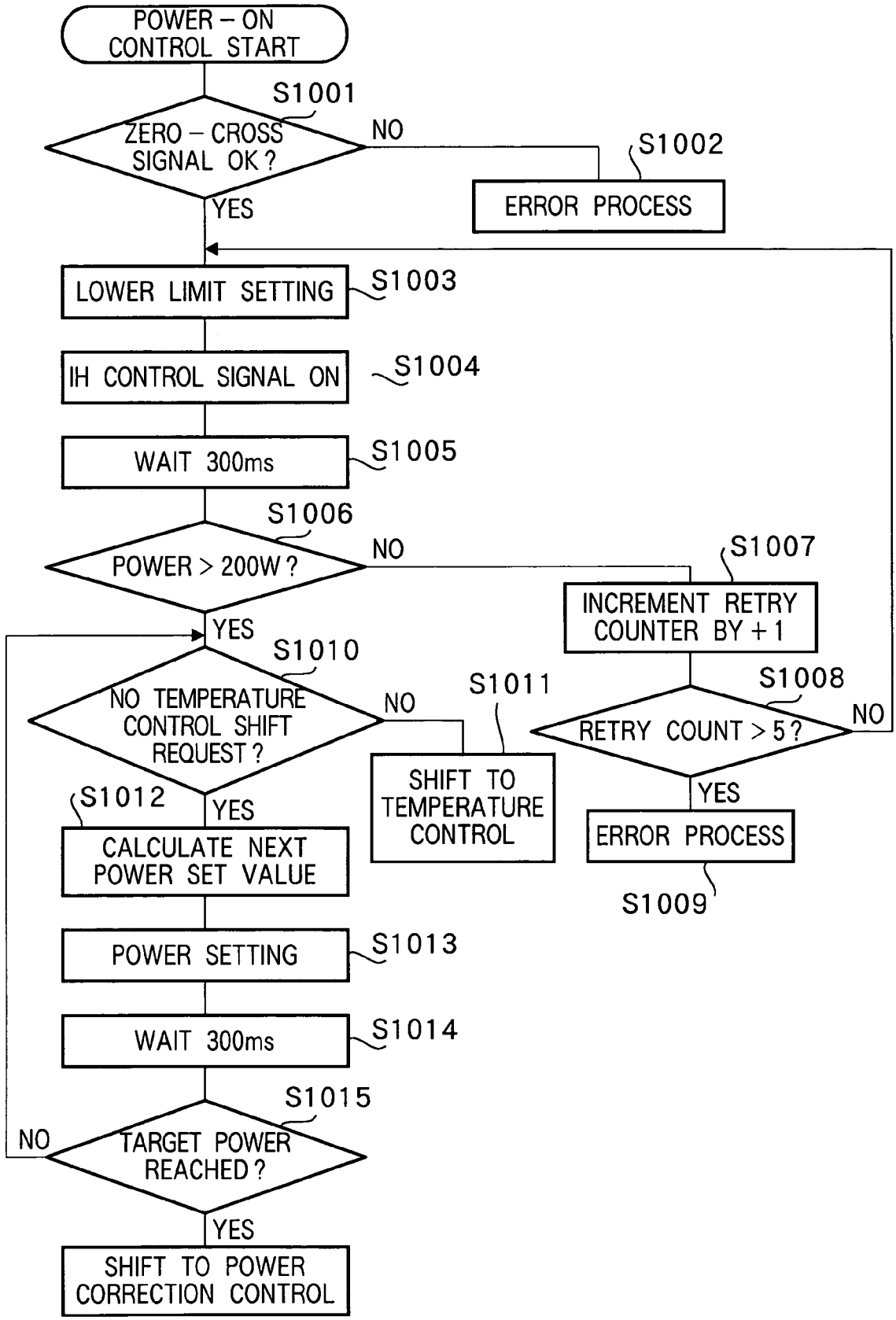
FIG. 10 is an operation flow chart of the fixing apparatus corresponding to Embodiment 1 in a power-on control state.

Next, the IH control method when power to the fixing apparatus 200 is turned ON will be explained. FIG. 10 is an operation flow chart in a power-on control state of the fixing apparatus 200.

When the image formation apparatus 100 receives a print request from an external PC (personal computer), etc., it starts heating control of the fixing apparatus 200, or so-called IH control, to fix the unfixed image onto the recording paper P.

In this IH control, the heat value control section 300 performs power-on control first. In this phase, as described above, a preparation process to increase the temperatures of the heat generating roller 220 and fixing belt 230 of the fixing apparatus 200 is performed until the temperature reaches a point at which the unfixed image can be fixed onto the recording paper P. Furthermore, in this phase, preparations for acquiring various types of data to perform IH control are realized.

Various types of data such as the input voltage for the inverter circuit, input current for the inverter circuit, frequency of the supply voltage, temperature of the fixing apparatus 200 are acquired after power to the image formation apparatus 100 is turned ON.

The input voltage for the inverter circuit is stored in a work memory (not shown) as digital data through the AD converter in the voltage value detection section 304 and given to the power value calculation section 306. Furthermore, the input current for the inverter circuit is stored in the work memory (not shown) as digital data through the AD converter in the voltage value detection section 304 and given to the power value calculation section 306. Then, the voltage value and current value are multiplied by the power value calculation section 306 and the power value to be supplied to the inverter circuit is calculated.

The heat value control section 300 of the fixing apparatus 200 performs data acquisition and calculation operation at 10 ms intervals and can respond to any variation of the supply voltage in real time. Furthermore, the voltage values acquired here are designed to become variation parameters to make the minimum power value (watt), target power value (watt), lower limit (register value) and limit value (register value) variable.

Furthermore, with respect to the frequency of the supply voltage, a zero-cross signal is input to a CPU (not shown) in the heat value control section 300 that carries out main control on the fixing apparatus 200 after power is turned ON as an interrupt signal and the frequency of the supply voltage is measured by measuring the period of generation of this interrupt signal.

Furthermore, with respect to the temperature of the fixing apparatus 200, an analog output from the temperature detector 270 made up of a thermo-sensitive device having high thermal response such as a thermistor is input to the supply power calculation section 301 through the AD converter of the temperature detection section 303 as digital data.

The heat value control section 300 of the fixing apparatus 200 repeatedly executes these operations at 10 ms intervals, and can thereby respond to a temperature variation of the fixing apparatus 200 in real time.

In FIG. 10, when the IH control of the heat value control section 300 is started, the zero-cross signal is checked first (step S1001). Here, the check is intended to confirm whether the zero-cross signal has been input or not and not to confirm a detailed period.

Here, if the power supply frequency is 50 Hz, the period is approximately 20 ms and if the power supply frequency is 60 Hz, the period is approximately 16.7 ms, and therefore if the zero-cross signal is normal, a zero-cross interrupt is generated for the CPU of the heat value control section 300 at this interval.

Furthermore, as the error condition in this embodiment, it constitutes an error when zero-cross interrupts are not generated successively for 1 sec or more and if such a state occurs, it is considered as an error and the operation of the image formation apparatus 100 is stopped (step S1002).

On the other hand, if it is confirmed in step S1001 that the zero-cross signal is normal, the heat value control section 300 sets the following lower limit (step S1003). The value of this lower limit (register value) corresponds to the minimum power.

Then, the IH control signal is turned ON (step S1004) and the heating operation of the fixing apparatus 200 is started by the heat value control section 300. After the IH control signal is turned ON, the heat value control section 300 waits for 300 ms (step S1005). This corresponds to the time after power is set in the power setting section 302 until the power is applied to the inverter circuit.

This wait time differs depending on the configuration of the inverter circuit. In this example, a wait time of 300 ms is secured. Furthermore, this wait time of 300 ms is the time in the direction in which power is increased. On the contrary, in the direction in which power is decreased, a wait time of 1500 ms is provided. The wait time in the direction in which power is decreased also depends on the configuration of the inverter circuit.

When 300 ms elapses after this IH control signal is turned ON, the heat value control section 300 checks the power applied to the inverter circuit (step S1006). This check is performed using the power value obtained by multiplying the current value and the voltage value input to the aforementioned inverter circuit by the power value calculation section 306.

Here, if a lower limit is set, substantially a minimum power value is returned as the power applied to the inverter circuit though there may be variations in inductances of the IH coil and fixing apparatus 200, or secular variation, etc. Though this minimum power value differs depending on the supply voltage or the voltage input to the inverter circuit, it is at least 300 W even in the case of lower than 185 V of the 200 V system as shown in FIG. 7.

With consideration given to this, if the power is 200 W or below without depending on the input voltage of the inverter circuit, the heat value control section 300 recognizes it as small power and carries out an error process. However, instead of immediately stopping IH control as a service call error at this time point, the heat value control section 300 retries a power setting and a power check. Then, when the heat value control section 300 performs that retry operation a default number of times or more, it stops the IH control as a service call error for the first time and stops all operations of the image formation apparatus 100.

More specifically, when the result of a power check by the heat value control section 300 shows that the power is 200 W or below, a counter for measuring a retry count (reset to 0 at the start of IH control) is incremented by +1 (step S1007). Then, the heat value control section 300 checks on whether the retry counter is greater than "5" or not, that is, checks on whether the retry count has exceeded 5 or not (step S1008). Here, if the retry count does not exceed 5, the heat value control section 300 returns to step S1003 to repeat the power setting operation. If the retry count exceeds 5, the heat value control section 300 regards it as a service call error, stops IH control and stops all operations of the image formation apparatus 100 (step S1009).

When it is confirmed that the power has been normally applied, the heat value control section 300 checks on whether there is a temperature control shift request or not (step S1010). The presence/absence of this request is decided based on the output from the temperature detection section 303 that detects the temperature of the fixing apparatus 200. As described above, this embodiment provides two thermistors which are temperature detection section 303 in the center and at one end of the fixing apparatus 200, but it is the thermistor in the center that is used for temperature control of this fixing apparatus 200.

This temperature control shift request is issued by the heat value control section 300 when the temperature reaches a temperature which is lower than the set temperature (which varies depending on the process speed, type of recording medium and environmental conditions, etc.) for fixing the unfixed image to the recording paper P by 20° C. (step S1011). For example, when the fixing set temperature is 170° C., a temperature control shift request is issued when the temperature of the fixing apparatus 200 reaches 150° C.

Here, after IH control is started, the temperature of the fixing apparatus 200 is normally low, and therefore control is seldom shifted to temperature control at this time. However, in intermittent printing with a short wait time, etc., the next printing is started when the fixing apparatus 200 is sufficiently heated by the previous printing, and therefore control is often shifted to temperature control immediately after a power check.

After this power check, if there is no temperature control shift request, the supply power calculation section 301 calculates a power value to be set next (step S1012). This is intended to calculate a power set value to be set next from the difference between the power value detected (calculated) 300 ms after the lower limit is set first and a minimum power value according to the input voltage of the inverter circuit at that time or the ratio of the two based on a predetermined calculation expression (not shown).

This power set value corresponds to the target power value. For example, when the minimum power value is 500 W and a lower limit is set and the actually returned power value is 400 W, the actual value is smaller than the theoretical value, and therefore the next set value is set to a relatively large value. On the contrary, when 600 W is returned, the actual value is larger than the theoretical value, and therefore the next set value is set to a relatively small value.

In this way, the power set value calculated by the supply power calculation section 301 is actually set (step S1013), and after a wait of 300 ms (step S1014), the heat value control section 300 checks on whether the target power has been reached or not (step S1015). If the target power has not been reached at this time, the heat value control section 300 returns to step S1010 to repeat the subsequent processes. On the other hand, if the target power is reached, the heat value control section 300 ends the power-on control and shifts to power correction control.

Figure 11:
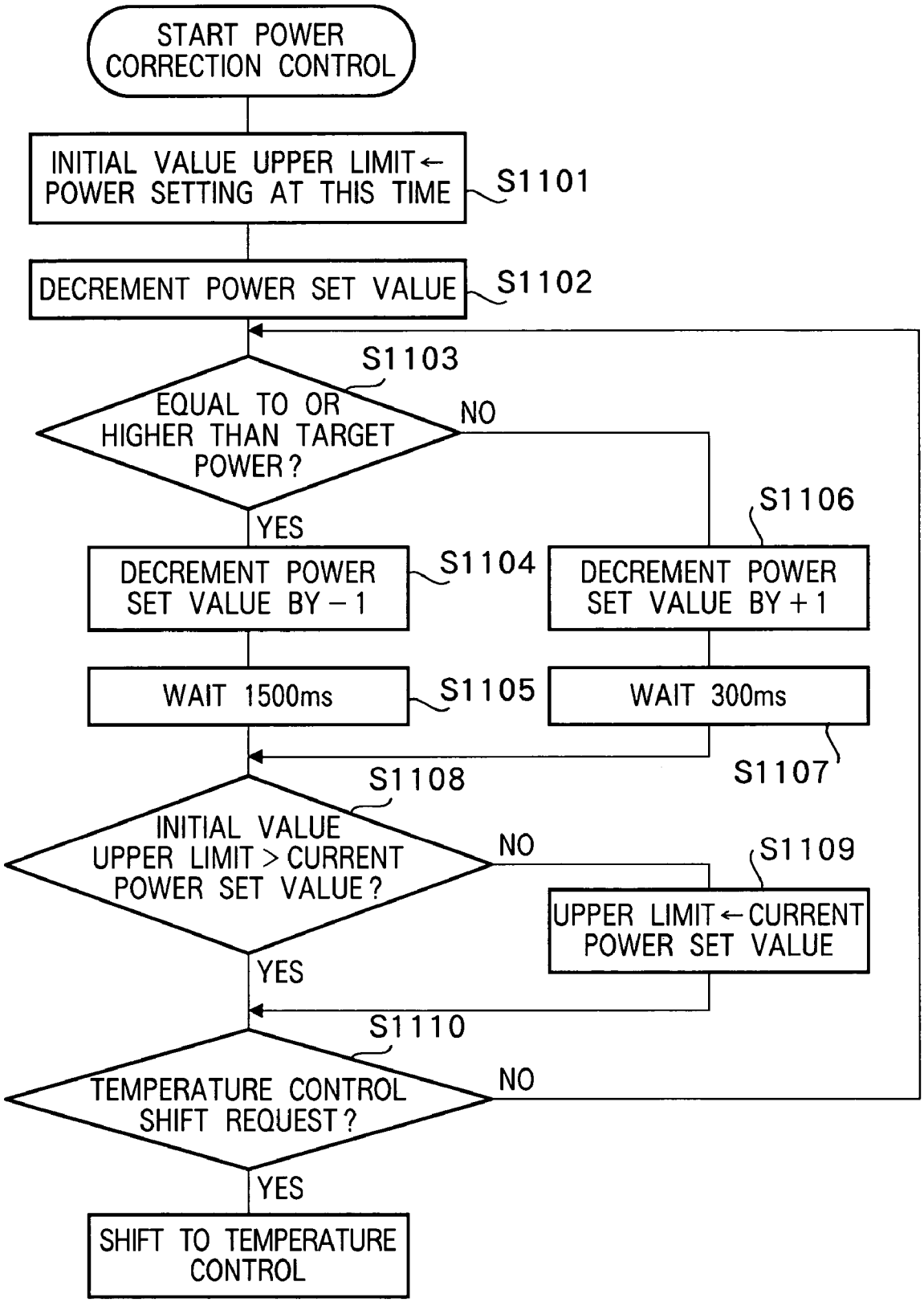
FIG. 11 is an operation flow chart of the fixing apparatus corresponding to Embodiment 1 in a power correction control state.

Next, the IH control method during the power correction control will be explained. FIG. 11 is an operation flow chart of the fixing apparatus 200 in a power correction control state.

During this power correction control, the heat value control section 300 stores the power set value immediately after the power-on control is shifted to the power correction control in a predetermined work area (not shown) as an upper limit value as shown in FIG. 11 (step S1101). This upper limit value is used as the upper limit value when a subsequent temperature control calculation is performed.

Furthermore, as described above, for the upper limit value when control is shifted to temperature control during power-on control, a predetermined default value (power set value corresponding to approximately 80% of target power in this embodiment) is used.

In this power correction control condition, the power set value is changed in increments of "+1" or "−1". That is, the supply power calculation section 301 carries out this power correction control by decrementing the power set value by "−1" when the power value exceeds the target power and incrementing by "+1" when the power value falls below the target power. Furthermore, immediately after a shift from the power-on control to power correction control, the power value exceeds the target power and the supply power calculation section 301 decrements the power set value by "−1" (step S1102).

Then, the supply power calculation section 301 checks the power given from the power value calculation section 306 (step S1103) and decrements the power set value by "−1" when the power value is equal to or greater than the target power (step S1104) and waits for 1500 ms (step S1105). Furthermore, when the power value falls below the target power value, the supply power calculation section 301 increments the power set value by "+1" (step S1106) and waits for 300 ms (step S1107).

Furthermore, with reference to the upper limit value and target power stored in the work area immediately after control is shifted from the power-on control to power correction control in midstream of this power correction control, the supply power calculation section 301 compares between the power set values obtained by incrementing by "+1" and "−1" (step S1108).

Here, if the power set value during power correction control exceeds the upper limit value stored in the work area, the supply power calculation section 301 updates the power set value using that value as a new upper limit value (step S1109). Then, the supply power calculation section 301 checks a temperature control shift request (step S1110), and if there is no request, the supply power calculation section 301 returns to step S1103 and repeats the processes.

Here, explanations of the temperature control shift request are the same as those of the power-on control, and therefore explanations here are omitted. When there is this temperature control shift request, a shift is made to temperature control.

Figure 12:
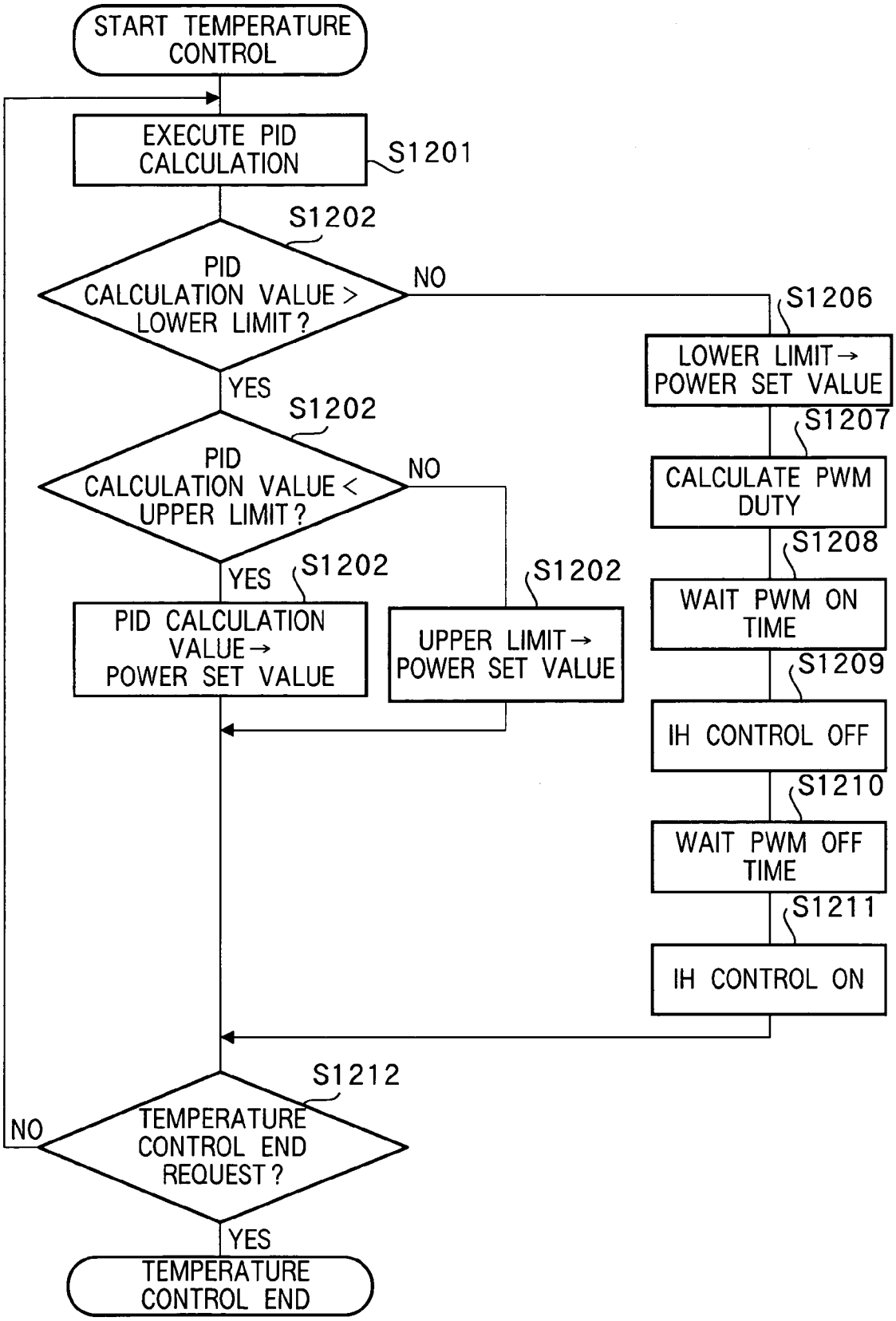
FIG. 12 is an operation flow chart of the fixing apparatus corresponding to Embodiment 1 in a temperature control state.

Next, the IH control method during temperature control will be explained in detail. FIG. 12 is an operation flow chart during the temperature control of the fixing apparatus 200.

A reference value for calculating a power set value during the power-on control and the power correction control is a power value calculated by the power value calculation section 306 from the current value and power value input to the inverter circuit. In contrast, a reference value for calculating a power set value during this temperature control is an output of thermistor (temperature detection section 303) in the central part of the fixing apparatus 200, that is, the temperature in the central part of the fixing apparatus 200.

As the calculation scheme for calculating power set values implemented by the supply power calculation section 301, a PID calculation for calculating a power set value according to the difference between a fixing set temperature (which varies depending on the process speed, type of the recording medium and environmental conditions, etc.) for fixing the unfixed image to the recording paper P and the actual temperature in the central part of the fixing apparatus 200 is used (step S1201).

Furthermore, the supply power calculation section 301 (not shown) starts to check the thermistor at an end of the fixing apparatus 200 at a time point at which control is shifted to this temperature control, regards it as an error that the difference between the temperature in the central part of the fixing apparatus 200 and the temperature at the end of the fixing apparatus 200 exceeds a certain default value and stops IH control.

This default temperature is set to 30° C. in this embodiment. That is, after the temperature in the central part of the fixing apparatus 200 reaches the fixing set temperature −20° C. (shifts to temperature control), it is regarded as an error if the temperature at the end of the fixing apparatus 200 is lower than the temperature in the central part of the fixing apparatus 200 by 30° C. or more.

In the PID calculation, a power set value is calculated according to a difference (hereinafter referred to as "deviation") between a fixing set temperature of an unfixed image (hereinafter simply referred to as "fixing set temperature")

according to the process speed, type of the recording medium and environmental conditions, etc., and output of the thermistor in the central part of the fixing apparatus 200 (hereinafter simply referred to as "fixing apparatus temperature"). Furthermore, in the PID calculation, a power set value is calculated according to the accumulated value of the above described differences (hereinafter referred to as "integral value") and the difference between the previous difference and the difference this time (hereinafter referred to as "derivation value"). Furthermore, this embodiment adopts PID control in which a power set value is calculated by multiplying the deviation and its integral value by a certain coefficient. The PID control calculation expression is as shown in the following Expression 12-1.

$$\text{Power set value}=Kp\{E(n)+Kt\times\Sigma E(n)\} \qquad \text{Expression 12-1}$$

where Kp=proportionality constant, Kt=integral constant and E(n)=deviation.

Here, the proportionality constant Kp and integral constant Kt are calculated using a threshold sensitivity method (not shown) which is one of known methods for calculating them. Then, fine adjustments are made to the values so that an overshoot when the set temperature is reached for the first time and temperature ripple during stationary control fall within an allowable range in consideration of characteristics of the control system (inductance variations of the fixing apparatus 200 and excitation coil 253, etc., in this embodiment) and final constants are determined. Furthermore, the sampling period for temperature control in this embodiment is 10 ms and a power set value is calculated according to the control rule in Expression 12-1 in this period.

Here, when a value calculated through the PID calculation is applied to the inverter circuit as the power set value as is, the value exceeding the aforementioned upper limit value or limit value or falling below the lower limit is output. This case may cause considerable inconvenience from the standpoint of protection of the inverter circuit or lead to destruction of the inverter circuit in the worst case.

In order to prevent this, this temperature control sets power and protects the inverter circuit while comparing the PI calculated value, and upper limit value and lower limit value which have already been calculated or predetermined in this temperature control phase all the time.

That is, during this temperature control, the supply power calculation section 301 makes a magnitude comparison between the PID calculated value with the lower limit (step S1202). If the PID calculated value>lower limit here, a magnitude comparison is made between the PID calculated value and upper limit value (step S1203). Here, if PID calculated value<upper limit value, the supply power calculation section 301 sets the PID calculated value as the power set value (step S1204).

Furthermore, when the PID calculated value exceeds the upper limit value, the supply power calculation section 301 sets the upper limit value as the power set value (step S1205). Then, the supply power calculation section 301 proceeds to check a temperature control end request (step S1212).

Next, in step S1202, temperature control in the case where the PID calculated value falls below the lower limit will be explained. This corresponds to the process from step S1206 to step S1211 in FIG. 12. If the PID calculated value can be set as the power set value, there is no problem, but as described above, there is some restriction on the power set value for protection of the inverter circuit.

The PID calculated value exceeds the upper limit value immediately after power correction control shifts to temperature control and this shift hardly occurs during stationary temperature control. However, on the contrary, such a state frequently occurs when the PID calculated value falls below the lower limit, the fixing apparatus 200 is heated and only small power suffices.

Thus, when the PID calculated value falls below the lower limit, if the power set value continues to be set to a lower limit, power which is greater than necessary power is supplied continuously and temperature control is performed with wrong information, which causes temperature control to fail.

Furthermore, when the PID calculated value falls below the lower limit, if the power set value is set to 0, power which is smaller than necessary power is still supplied continuously and temperature control is performed with wrong information, which likewise causes temperature control to fail.

Therefore, to prevent this, this temperature control performs PWM control according to the ratio of the PID calculated value to the lower limit to realize compatibility between protection of the inverter circuit and temperature control.

The method for this temperature control will be explained more specifically below.

In FIG. 12, when the PID calculated value falls below the lower limit in step S1202, the supply power calculation section 301 sets a lower limit as the power set value (step S1206). Next, the supply power calculation section 301 calculates an ON/OFF duty of PWM control (step S1207).

For example, if the PID calculated value is 20 (hexadecimal) HEX, when the lower limit is assumed to be 40 (hexadecimal notation) HEX, the ON ratio is 50%. Therefore, in this case, if PWM control with ON duty 50% and OFF duty 50% is performed, this means that PID calculated value 20HEX is set as a pseudo-power setting.

As another example, if the PID calculated value is 10 (hexadecimal) HEX when the lower limit is assumed to be 40 (hexadecimal notation) HEX, the ON ratio is 25%. Therefore, if PWM control with ON duty 25% and OFF duty 75% is performed, this means that power of PID calculated value 10HEX is set as a pseudo-power setting.

In this way, when the PID calculated value falls below the lower limit, power is set according to ON/OFF duty of the PWM control calculated as described above. Here, a value experimentally calculated by changing the process speed, etc., is used as the PWM control sampling period and it is, for example, 40 ms at a stationary speed (100 mm/s) in this embodiment.

Next, the supply power calculation section 301 waits for an ON time in PWM control calculated from the ON/OFF duty of the PWM control and PWM control sampling period (step S1208). After this ON-time wait, the IH control signal is turned OFF (step S1209) and waits for an OFF time in PWM control (step S1210).

Then, after an OFF-time wait, the supply power calculation section 301 turns ON the IH control signal (step S1211) and proceeds to the temperature control end check (step S1212). Here, if there is a temperature control end request, the supply power calculation section 301 ends the temperature control and stops the IH control. On the other hand, if there is no temperature control end request, the supply power calculation section 301 returns to step S1201 and continues temperature control.

As explained in FIG. 4, when it is detected that power supplied to the inverter circuit is equal to or higher than the limit power during power-on control, power correction control or temperature control, or when the power set value is equal to or higher than the limit value, the heat value control section 300 controls the power set value so that the power supplied becomes a value smaller than the target power (e.g., power value 80% of target power), thus preventing IH control trouble due to destruction of the inverter circuit and misoperation of the inverter circuit.

Figure 13:
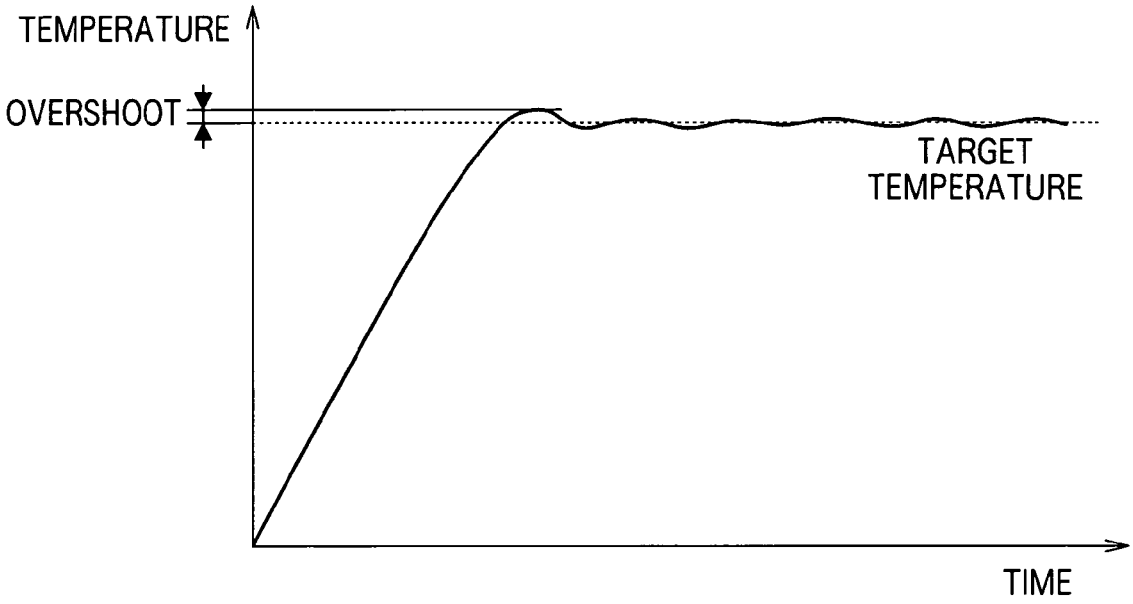
FIG. 13 is a graph showing a belt temperature variation of a fixing belt when the fixing apparatus corresponding to Embodiment 1 is heated from a low-temperature state.

However, as shown in FIG. 13, when the temperature of the overall apparatus of this type of the fixing apparatus 200 is low, it is preferable to apply heating through PID control with such a setting that the temperature of the fixing belt 230 overshoots the target temperature to a certain degree because the warm-up time is shortened in this way.

Figure 14:
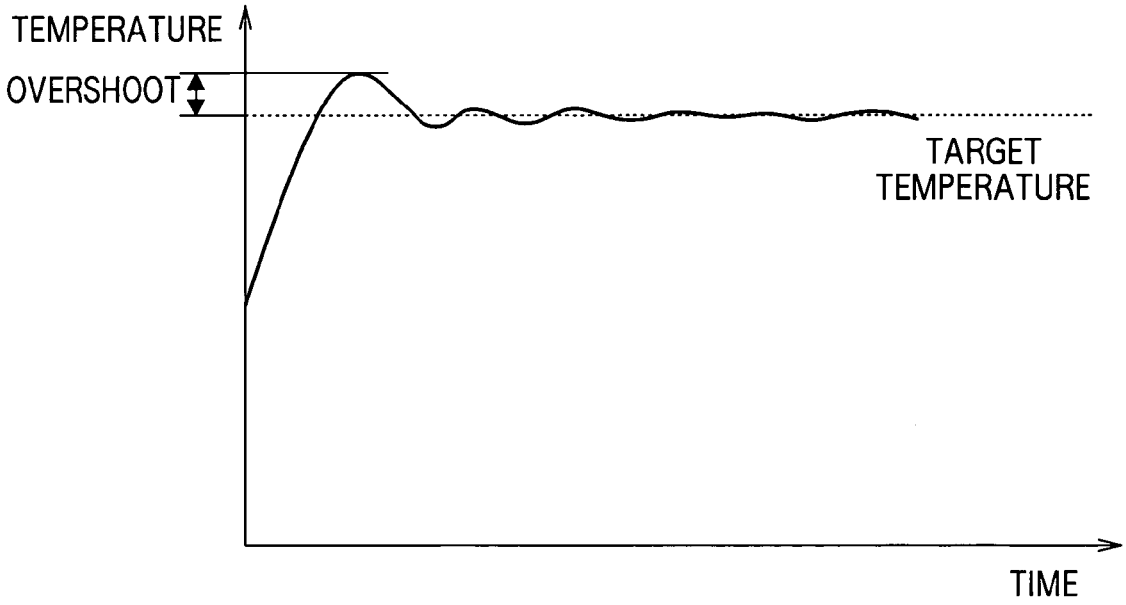
FIG. 14 is a graph showing a belt temperature variation of a fixing belt when the fixing apparatus corresponding to Embodiment 1 is heated from a high-temperature state.

However, when the ambient temperature of the fixing apparatus 200 is already high, as shown in FIG. 14, when the fixing belt 230 is heated next, heating the fixing belt 230 through PID control with the same setting as that in the case where the temperature of the fixing apparatus 200 is low increases the speed of a temperature rise of the fixing belt 230 and increases the overshoot.

Furthermore, the magnetic characteristic of the fixing belt 230 changes as the temperature increases. For this reason, when the fixing belt 230 is heated through PID control with the same setting as that when the temperature of the fixing apparatus 200 is low, there is a problem that it is difficult to enter the output when the temperature of the fixing apparatus 200 is high.

Therefore, with this fixing apparatus 200, a smaller proportionality factor of PID control is set for a higher temperature of the fixing belt 230. Then, even if the deviation between the detected temperature of the temperature detector 270 (current temperature of the fixing belt 230) and the target temperature (set temperature) of the fixing belt 230 is the same deviation, an amount of operation of the supply power calculation section 301 is prevented from being drastically increased.

The calculation expression for the PID calculation by this fixing apparatus 200 is expressed by:

$$\mathrm{RegVal}=\mathrm{Kp}\{(\mathrm{Tref}-\mathrm{Tnow})+1/Ki\cdot\{(\mathrm{Tref}-\mathrm{Tnow})+Tf\}+Kd(d(\mathrm{Tref}-\mathrm{Tnow})/dt)\} \qquad \text{Expression 15-1}$$

where Kp is a proportionality factor, Ki is an integral coefficient, Kd is a differential coefficient, Tf is an integral initial value, Tref is a set temperature (target temperature), Tnow is a current temperature (detected temperature).

As shown in Expression 15-1, PID control performs integral control using the integral value of a deviation between the set temperature and current temperature.

Figure 15:
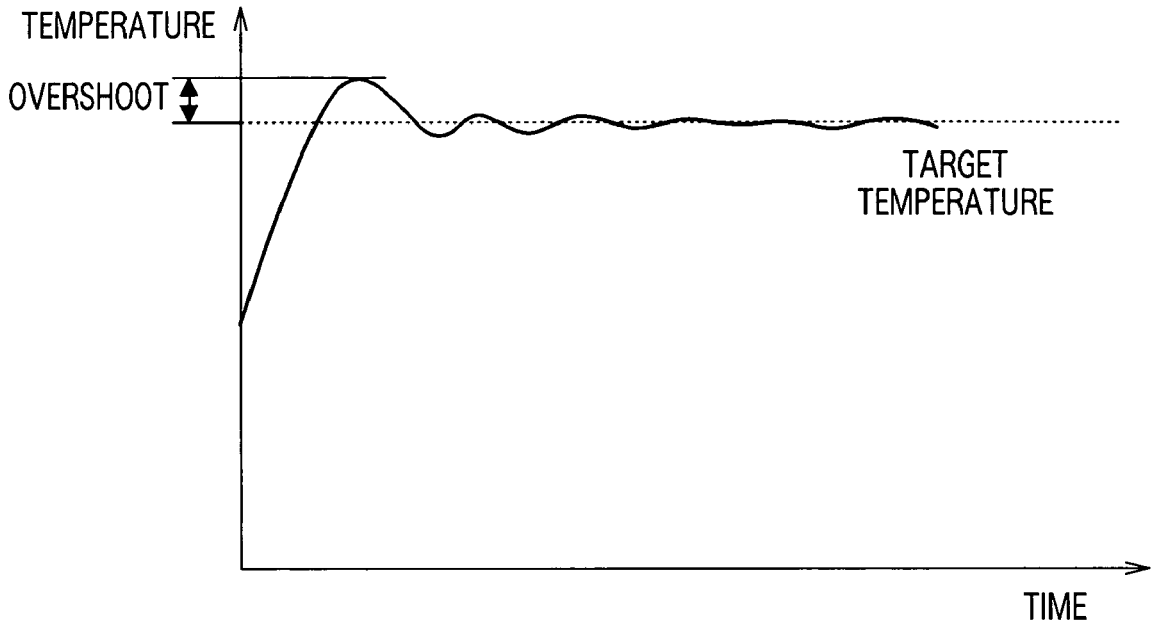
FIG. 15 illustrates a graph showing a belt temperature variation of a fixing belt when a proportionality factor Kp during the PID control corresponding to Embodiment 1 is large.

Therefore, during this PID control, when the proportionality factor Kp in Expression 15-1 is large, the fixing belt 230 reaches the target temperature more quickly as shown in FIG. 15, but the subsequent overshoot becomes bigger.

Figure 16:
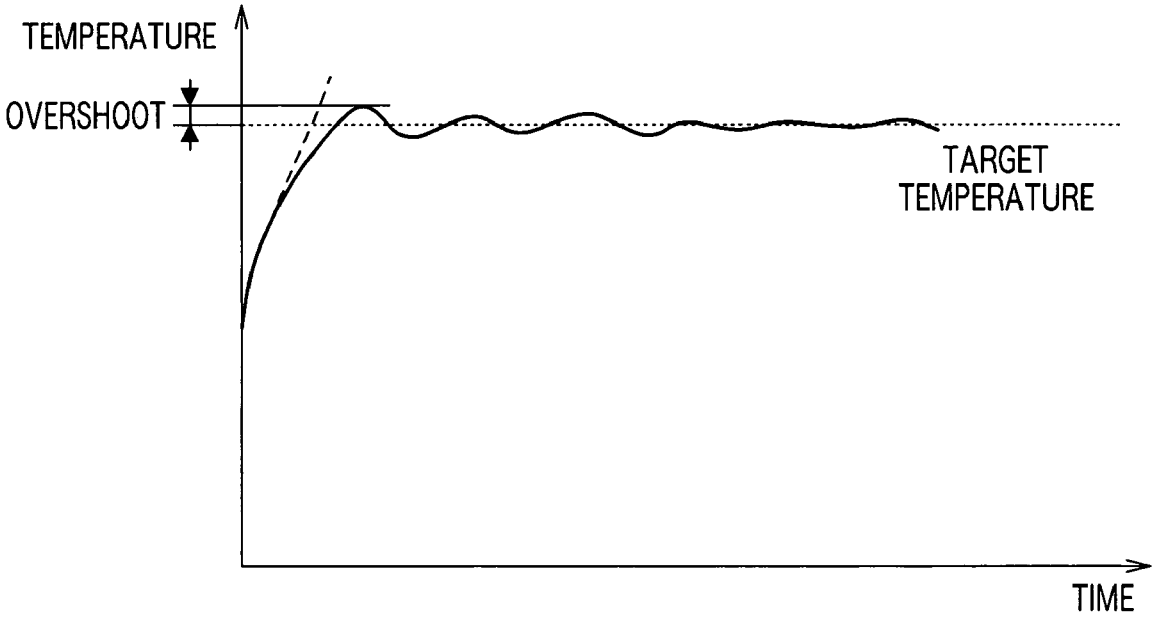
FIG. 16 illustrates a graph showing a belt temperature variation of a fixing belt of a fixing apparatus using the image heating apparatus corresponding to Embodiment 1.

In contrast, when the proportionality factor Kp in Expression 15-1 is small, the output is reduced gradually as shown in FIG. 16, and therefore the fixing belt 230 reaches the target temperature more slowly but the overshoot becomes smaller.

Thus, the heat value control section 300 of the fixing apparatus 200 using the image heating apparatus according to Embodiment 1 changes the control value of the PID control according to the temperature (belt temperature) at the start of heating of the fixing belt 230 detected by the temperature detector 270.

More specifically, as shown in Table 1, the proportionality factor Kp of the calculation expression of the PID calculation is changed according to the belt temperature of the fixing belt 230.

TABLE 1

| Belt temperature | Up to 70° C. | 71 to 120° C. | 121° C. or above |
|---|---|---|---|
| Kp | 20 | 15 | 10 |

This fixing apparatus 200 can reduce the overshoot at the time of a temperature rise of the fixing belt 230.

Embodiment 2

Next, an image heating apparatus according to Embodiment 2 of the present invention will be explained.

Figure 17:
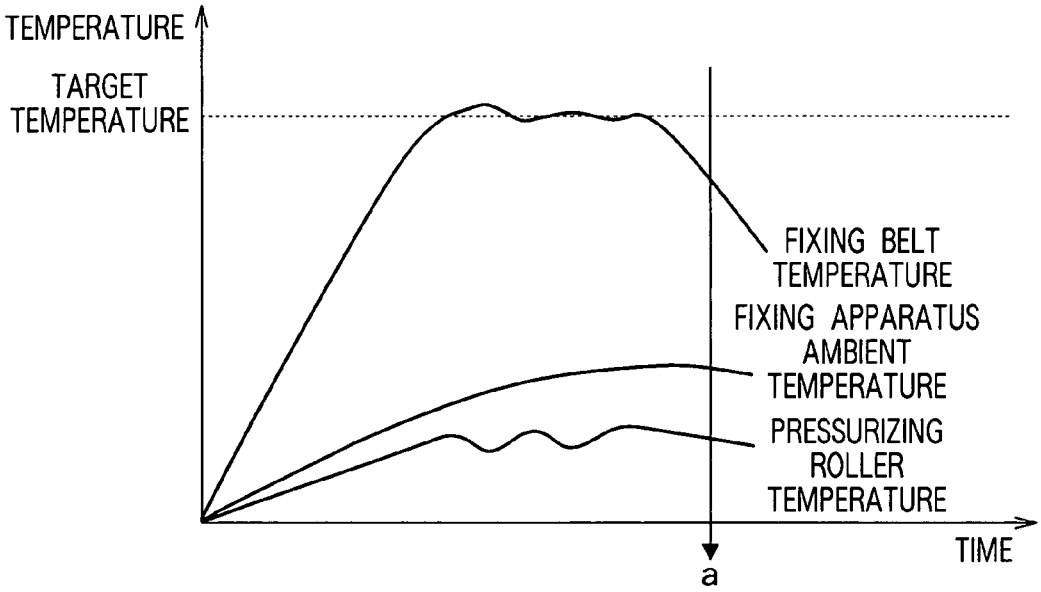
FIG. 17 illustrates a graph showing a belt temperature variation of a fixing belt for illustrating a fixing apparatus using the image heating apparatus corresponding to Embodiment 2 when an ambient temperature is low.

The fixing belt 230 of the fixing apparatus 200 has a smaller heat capacity and quicker temperature drop. For this reason, when the first page is printed after the power to the image formation apparatus 100 is turned ON, as shown, for example, in FIG. 17, the ambient temperature of the fixing apparatus 200 at time a is low, but the temperature of the fixing belt 230 is high because it is immediately after the printing.

Figure 18:
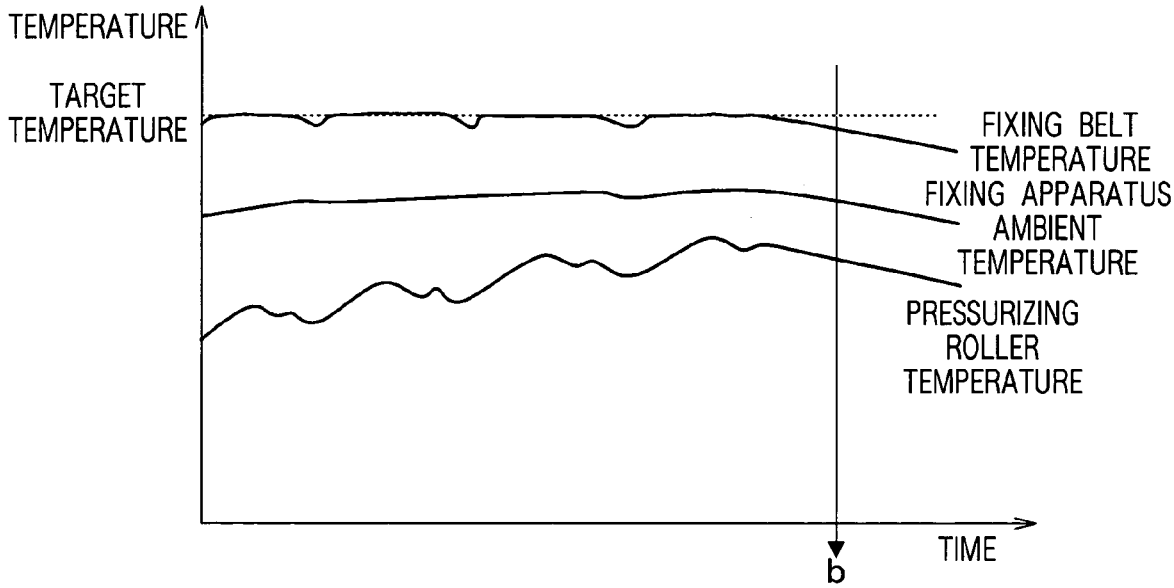
FIG. 18 illustrates a graph showing a belt temperature variation of a fixing belt for illustrating a fixing apparatus using the image heating apparatus corresponding to Embodiment 2 when an ambient temperature is high.

On the other hand, when printing by the image formation apparatus 100 is carried out consecutively or intermittently, as shown in FIG. 18, the temperature of the fixing belt 230 and ambient temperature of the fixing apparatus 200 are high at a time b, and the temperature of the pressurizing roller 240 is also high.

Therefore, in order to keep the temperature of the fixing belt 230 to an image fixing temperature appropriate for heating and fixing of an unfixed image to the recording paper P, it is preferable to change the control value of PID control according to the temperature of the pressurizing roller 240 instead of the temperature of the fixing belt 230 which is easily changeable.

Thus, in the heat value control section 300 of the fixing apparatus 200 using the image heating apparatus according to Embodiment 2, as shown in FIG. 2, the supply power calculation section 301 changes the control value of PID control according to the temperature of the pressurizing roller 240 detected by the temperature detector 290 which is disposed close to the pressurizing roller 240.

More specifically, as shown in Table 2, the proportionality factor Kp of the calculation expression of the PID calculation is changed according to the pressurizing roller temperature of the pressurizing roller 240.

TABLE 2

| Pressurizing roller temperature | Up to 80° C. | 80 to 110° C. | 111° C. or above |
|---|---|---|---|
| Kp | 20 | 15 | 10 |

In the heat value control section 300 of this fixing apparatus 200, the control value of PID control is changed according to the temperature of the pressurizing roller 240 instead of the temperature of the fixing belt 230 which is easily changeable, and therefore it is possible to reach a target temperature in a short time without causing the temperature of the fixing belt 230 to overshoot considerably.

Embodiment 3

Next, an image heating apparatus according to Embodiment 3 of the present invention will be explained.

Figure 19:
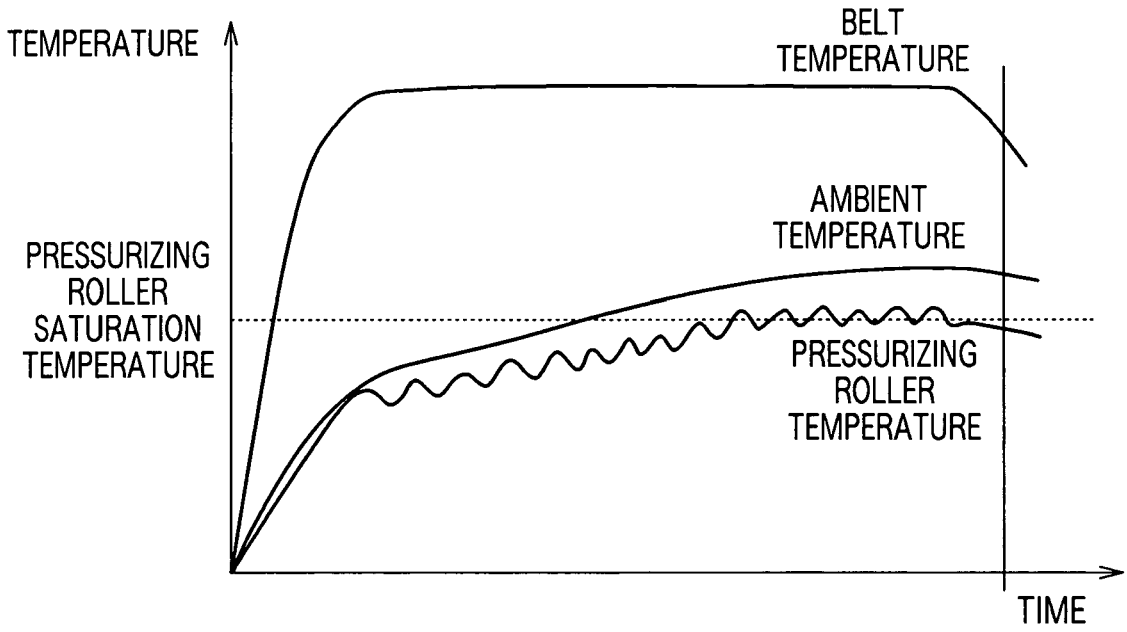
FIG. 19 is a graph showing a belt temperature variation of a fixing belt for illustrating a fixing apparatus using an image heating apparatus corresponding to Embodiment 3 when serial printing is performed from a low-temperature state of a pressurizing roller.

The temperature of the pressurizing roller 240 of the fixing apparatus 200 increases gradually with serial printing when serial printing is performed from a low-temperature state, but as shown in FIG. 19, saturation occurs at a pressurizing roller saturation temperature around, for example, 90° C. In this case, the ambient temperature of the fixing apparatus 200 is close to the temperature of the pressurizing roller 240.

Figure 20:
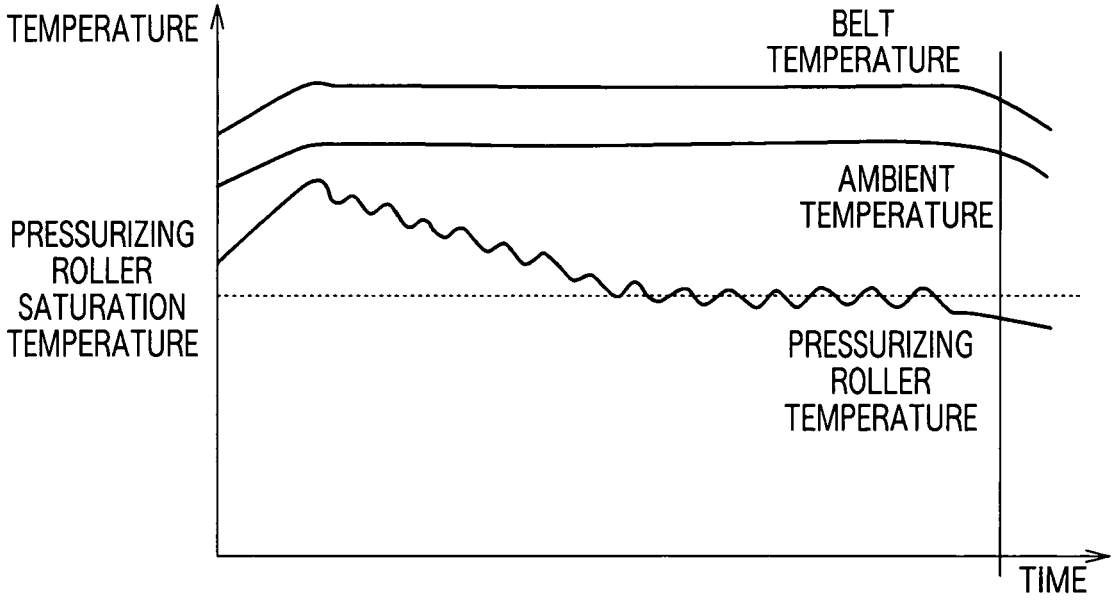
FIG. 20 is a graph showing a belt temperature variation of a fixing belt for illustrating a fixing apparatus using an image heating apparatus corresponding to Embodiment 3 when serial printing is performed from a high-temperature state of a pressurizing roller.

In contrast, when serial printing is performed when the temperature of the pressurizing roller 240 is high due to intermittent printing, etc., the pressurizing roller 240 is deprived of heat when recording paper P passes through, and the temperature of the pressurizing roller 240 decreases gradually as shown in FIG. 20 and almost stabilizes at a pressurizing roller saturation temperature, for example, between 80° C. and 90° C.

For this reason, when such serial printing continues for a long time, the ambient temperature of the fixing apparatus 200 increases, whereas the temperature of the pressurizing roller 240 may fall below the ambient temperature of the fixing apparatus 200.

In such a case, when the fixing belt 230 is heated next, the speed of a temperature rise of the fixing belt 230 increases, likely to cause an overshoot.

Thus, in the heat value control section 300 of the fixing apparatus 200 using the image heating apparatus according to this Embodiment 3, when the pressurizing roller 240 is cooled down to a temperature lower than a certain default value (e.g., below 80° C.), the supply power calculation section 301 changes the control value of PID control according to the temperature of the pressurizing roller 240.

Furthermore, when the temperature of the pressurizing roller 240 is equal to or higher than the default value, the supply power calculation section 301 changes the control value of PID control according to the temperature of the fixing belt 230.

More specifically, as shown in Table 3, the proportionality factor Kp of the calculation expression of the PID calculation is changed according to the belt temperature of the fixing belt 230 and pressurizing roller temperature of the pressurizing roller 240.

TABLE 3

| Belt temperature | | 81 to 120° C. | 121° C. or above |
|---|---|---|---|
| Pressurizing roller temperature | Up to 80° C. | 81° C. or above | 81° C. |
| Kp | 20 | 15 | 10 |

In this fixing apparatus 200, even if the ambient temperature of the fixing apparatus 200 is high as in the case after serial printing of the image formation apparatus 100, it is possible to reduce an overshoot when the fixing belt 230 is heated next.

Embodiment 4

Next, an image heating apparatus according to Embodiment 4 of the present invention will be explained.

The fixing apparatus 200 shown in FIG. 2 is provided with a cover to cover the fixing belt 230 and pressurizing roller 240 together so that the temperatures of the fixing belt 230 and pressurizing roller 240 are not inverted.

Therefore, in this fixing apparatus 200, when the belt temperature of the fixing belt 230 is low, the pressurizing roller temperature of the pressurizing roller 240 is always low, too.

Figure 21:
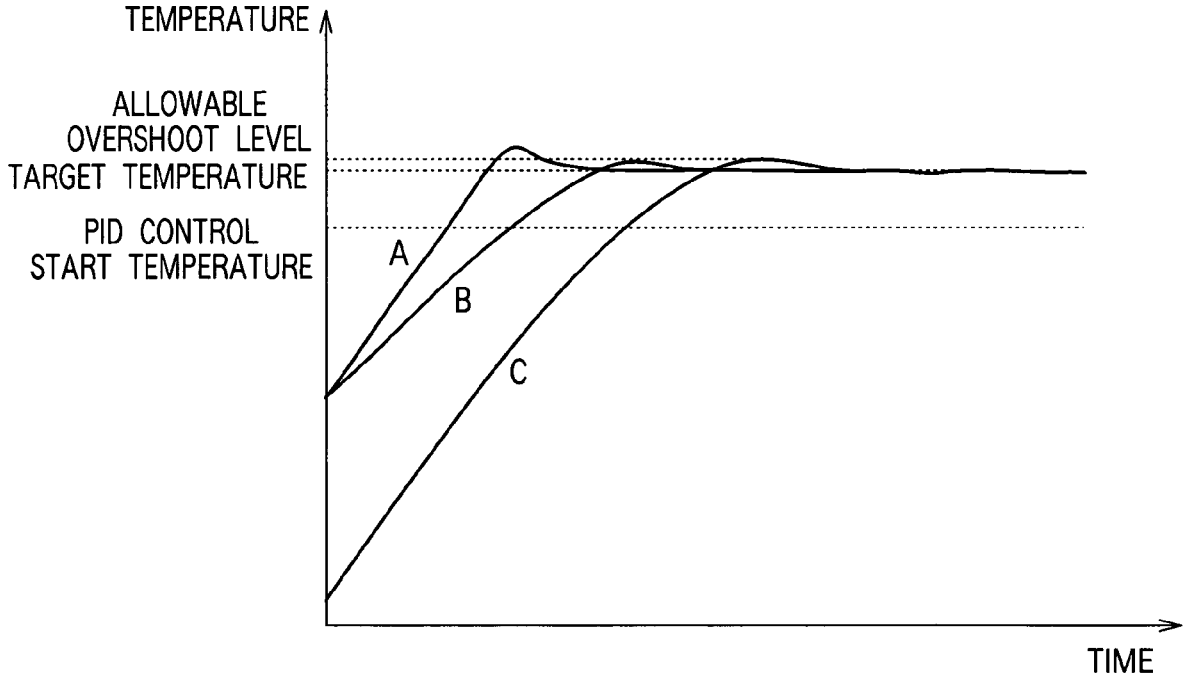
FIG. 21 is a graph showing a belt temperature variation of a fixing belt for illustrating a fixing apparatus using an image heating apparatus corresponding to Embodiment 4.

For this reason, in this fixing apparatus 200, when the temperature of the fixing belt 230 is increased with full power from a state in which the ambient temperature is high and the pressurizing roller temperature of the pressurizing roller 240 is also high, that is, from a state in which the belt temperature of the fixing belt 230 is high, a greater overshoot appears as shown with a line A in FIG. 21.

In FIG. 21, the line A indicates a case where the fixing belt 230 is heated with full power from a state in which the belt temperature is high, the line B indicates a case where the fixing belt 230 is heated with small power from a state in which the belt temperature is high and the line C indicates a case where the fixing belt 230 is heated with full power from a room temperature.

Thus, in the heat value control section 300 of the fixing apparatus 200 using the image heating apparatus according to this Embodiment 4, the supply power calculation section 301 sets a first target power and second target power as maximum input power during the PID control. Then, when the first target power is smaller than the second target power, the supply power calculation section 301 changes the second target power (maximum input power) according to the temperature of the fixing belt 230 at the start of heating detected by the temperature detector 270.

More specifically, as shown in Table 4, the second target power (maximum input power) is changed according to the belt temperature of the fixing belt 230.

TABLE 4

| Belt temperature | Up to 70° C. | 71 to 120° C. | 121° C. or above |
|---|---|---|---|
| Maximum input power | 1200 W | 1100 W | 1000 W |

This fixing apparatus 200 controls the target value of the PID control by changing the second target power (maximum input power) according to the temperature of the fixing belt 230 at the start of heating.

Therefore, in the heat value control section 300 of this fixing apparatus 200, as shown by a line B in FIG. 21, even in the case where the temperature of the fixing belt 230 at the start of heating is high and the second target power is applied as the maximum input power, this second target power (maximum input power) is changed according to the temperature of the fixing belt 230 at the start of heating, and therefore it is possible to suppress a drastic temperature rise of the fixing belt 230. A line C shown in FIG. 21 indicates a temperature variation of the fixing belt 230 when the fixing belt 230 is heated with full power from a room temperature.

Here, the heat value control section 300 changes the second target power (maximum input power) according to the temperature of the fixing belt 230 at the start of heating, but this second target power (maximum input power) may also be adapted so as to be changed according to the temperature of the pressurizing roller 240 detected by the temperature detector 290.

Therefore, this configuration can suppress a drastic temperature rise of the fixing belt 230 even in the case where the temperature of the fixing belt 230 at the start of heating is high and the second target power is applied as the maximum input power.

Furthermore, the heat value control section 300 of the fixing apparatus 200 may also be constructed so that the supply power calculation section 301 changes the control value of the PID control and the second target power value according to the temperature of the fixing belt 230 at the start of heating detected by the temperature detector 270.

Therefore, this configuration can reduce the overshoot more effectively at the time of a temperature rise of the fixing belt 230.

Furthermore, the heat value control section 300 of this fixing apparatus 200 can also be constructed so that the supply power calculation section 301 changes the control value of the PID control and the second target power value according to the temperature of the pressurizing roller 240 detected by the temperature detector 290.

Therefore, this configuration allows the temperature of the fixing belt 230 to reach a target temperature more effectively and in a short time without any considerable overshoot.

Furthermore, the heat value control section 300 of the fixing apparatus 200 may also be adapted so that when the temperature of the pressurizing roller 240 is lower than a predetermined default value, the supply power calculation section 301 changes the control value of the PID control and the second target power value according to the temperature of the pressurizing roller 240 detected by the temperature detector 290 and changes the control value of the PID control and the second target power value according to the temperature of the fixing belt 230 detected by the temperature detector 270 when the temperature of the pressurizing roller 240 is equal to or higher than the default value.

Therefore, this configuration can reduce the overshoot more effectively when the fixing belt 230 is heated next even when the ambient temperature of the fixing apparatus 200 is high, for example, after serial printing.

Embodiment 5

Next, an image heating apparatus according to Embodiment 5 of the present invention will be explained.

PID control performs integral control using an integral value of a deviation between a set temperature (target temperature) and current temperature (detected temperature).

When PID control is started from a state in which the current temperature is low, the integral value is accumulated gradually, and therefore temperature control functions ideally.

However, when PID control is started from a state in which the current temperature is already high, there is no accumulation of integral values so far, and therefore an overshoot is likely to occur.

Thus, in the heat value control section 300 of the fixing apparatus 200 using the image heating apparatus according to this Embodiment 5, the supply power calculation section 301 adds an initial value of the integral obtained beforehand to the sum of the deviations and calculates an amount of operation of the PID control.

That is, when the temperature of the pressurizing roller 240 is equal to or higher than the default value, the supply power calculation section 301 does not change the coefficient of the PID control and changes only an initial value of the integral so that the temperature takes a value obtained by adding the integral value of a deviation between a target temperature and detected temperature when the temperature of the pressurizing roller 240 is lower than a predetermined default value.

More specifically, as shown in Table 5, the integral initial value Tf in the calculation expression of the PID calculation is changed according to the belt temperature of the fixing belt 230.

TABLE 5

| Belt temperature | Up to 70° C. | 71 to 120° C. | 121° C. or above |
|---|---|---|---|
| Tf | 2000 | 2500 | 3000 |

This fixing apparatus 200 can control the temperature of the fixing belt 230 so as to reduce an overshoot.

The present invention is not limited to the above described embodiments, and various variations and modifications may be possible without departing from the scope of the present invention.

This application is based on the Japanese Patent Application No. 2004-068033 filed on Mar. 10, 2004, entire content of which is expressly incorporated by reference herein.

What is claimed is:

1. An image heating apparatus comprising:

an image heater that heats an unfixed image on a recording medium;

a heat generator that induction-heats said image heater;

a temperature detector that detects a temperature of said image heater; and a power controller that controls power supplied to said heat generator by PID control based on the temperature detected by said temperature detector so that the temperature of said image heater is maintained at an image fixing temperature appropriate for heating and fixing of said unfixed image to the recording medium, wherein said power controller changes the control value of said PID control according to the temperature at a start of heating of said image heater detected by said temperature detector, wherein said PID control relates to a deviation between the temperature detected by the temperature detector and a target temperature of the image heater, and is controlled by a combination of a value of elements proportional to said deviation, a value of elements proportional to an integral of said deviation and a value of elements proportional to a derivative of said deviation, wherein said power controller changes a proportionality factor of the deviation, said integral of the deviation and said derivative of the deviation in accordance with the temperature at the start of heating of said image heater, whereby said power controller changes the control value of said PID control.

2. The image heating apparatus according to claim 1, wherein said power control section has first target power and second target power as maximum input power input during said PID control, and changes, when said first target power is smaller than said second target power, said second target power according to the temperature at the start of heating of said image heating body detected by said temperature detection section.

3. The image heating apparatus according to claim 1, wherein said power control section has first target power and second target power as maximum input power input during said PID control, and changes, when said first target power is smaller than said second target power, the control value of said PID control and said second target power according to the temperature at the start of heating of said image heating body detected by said temperature detection section.

4. A fixing apparatus comprising an image heater that heats an unfixed image on a recording medium, wherein the image heating apparatus according to claim 1 comprises said image heater.

5. An image formation apparatus comprising:

an image former configured to form an unfixed image on a recording medium; and a fixer configured to heat and fix the unfixed image formed on the recording medium, wherein the fixing apparatus according to claim 4 comprises said fixer.

* * * * *